US005971096A

United States Patent [19]

Matsumoto et al.

[11] Patent Number: 5,971,096

[45] Date of Patent: Oct. 26, 1999

[54] NOISE BARRIER AND METHOD OF INSTALLING SAME

[75] Inventors: Koich Matsumoto, Kanagawa-ken; Minoru Yamamoto, Tokyo; Toshikazu Osafune, Kanagawa-ken; Toshiyuki Watanabe, Tokyo; Teruo Nakazawa, Tokyo; Hiroshi Shima, Tokyo, all of Japan

[73] Assignees: Nihon Doro Kodan; Bridgestone Corporation, both of Tokyo, Japan

[21] Appl. No.: 09/203,210

[22] Filed: Nov. 30, 1998

[30] Foreign Application Priority Data

Dec. 1, 1997 [JP] Japan ..... 9-345833

[51] Int. Cl.[6] ..... G10K 11/00

[52] U.S. Cl. ..... 181/210; 181/287

[58] Field of Search ..... 181/210, 284, 181/286, 287; 52/144, 145

[56] References Cited

U.S. PATENT DOCUMENTS 3,007,539 11/1961 Brewer et al. ..... 181/210

5,741,369 4/1998 Yamamura et al. ..... 181/210

*Primary Examiner*—Khanh Dang

*Attorney, Agent, or Firm*—Jordan and Hamburg LLP

[57] ABSTRACT

A noise barrier includes upright-standing support columns spaced a predetermine distance from each other and each made of an H section, and a plurality of wall panels provided between two neighboring ones of the support columns by inserting each wall panel at opposite lateral edges thereof from above into U-shaped recesses, opposite to each other, of the support columns, the plurality of wall panels being thus stacked one on another to form a main soundproof wall, and a noise control module to be installed on the topmost wall panel, the noise control module comprising side frame members to be inserted at lower ends thereof from above into the upper portions of the U-shaped recesses, opposite to each other, of the support columns; a lower frame member connecting the side frame members to each other by securing them at lower ends thereof to the lower frame member; first and second additional screens installed at lower ends thereof pivotably to the lower frame member and having a horizontal length smaller than the distance between the support columns; a coupling member holding the first and second additional screens at a predetermined angle of inclination when the additional screens are inclined toward and away from a noise source, respectively; and sound insulation joint sheets elastically extensible horizontally and bridging, over the support column, two additional screens put in neighboring relationship when the first and second additional screens are opened away from each other.

5 Claims, 24 Drawing Sheets

NOISE BARRIER AND METHOD OF INSTALLING SAME

BACKGROUND OF THE INVENTION

1. Field of the Invention

The present invention relates to a noise barrier to control or attenuate undesired sounds or noises coming from streets and highways, railways, factories, etc., and more particularly to a noise control module and a method of installing the noise control module.

2. Description of the Prior Art

Conventionally, to attenuate noises from streets and highways, railways, factories or the like, various wall types of noise barrier are prevalently used to block noises from coming directly from such noise sources. This is because the wall-type noise barrier structures are of relatively low cost while working as effectively as various other noise control modalities.

Among the noise control structures, upright or vertical straight wall types of noise barriers are used most widely because they show a high effect of noise control for their relatively low costs and are widely applicable for controlling noises from various sources. For a higher effect of noise control, the vertical straight wall type noise barriers have to be taller. However, such taller ones are correspondingly more expensive (the taller the wall, the greater construction costs they need). In addition, the taller walls have many other disadvantages such as interception of sunlight, obstruction of view (shut-off of prospect), oppressive sensation or claustrophobia, ill ventilation, radio interference or jamming, turbulent flow, wind load, etc.

Using such a vertical straight wall type noise barrier only will not be a satisfactory solution to the noise-control problem in some cases. For an improved noise control, it has been proposed to use various other types of noise barriers including bent-top types of which the wall top portion is bent toward the noise source and curved-top types of which the wall top portion is curved toward the noise source. However, it has also been known that use of a noise barrier of such a bent- or curved-top type will make the above-mentioned problems more serious.

The recent drastic increase of the traffic and higher speed capability of vehicles have resulted in serious environmental noise problem. Since no other effective noise control solutions have been available, the noise barriers of the vertical straight wall type of 3 m, 7 m and 10 m in height and also the above-mentioned bent-top and curved-top types of noise barriers, are used. However, the above-mentioned environmental problems still remain unsolved.

The above conventional noise barriers can only provide an effect of noise attenuation improved for an increased wall height. Generally, at a place (about 20 meters) separate from the noise barrier, an increase by 1 m in height of the wall only results in a noise attenuation of about 1 dB.

To attain a higher effect of noise control without increasing the wall height, a noise barrier structure has been proposed which has a generally Y-type cross section, Y-type being formed by a main soundproof wall and two additional top screens provided on top of the main body and define an upward opening between them. The noise control or attenuation by this Y-type noise barrier was evaluated by measuring noise level at a place behind the barrier when viewed from a noise source. Also a noise barrier of a vertical straight wall type as tall as the Y-type one was evaluated concerning its effect of noise attenuation. Thus, the noise attenuation (measured sound levels) by the Y-type barrier was compared with that by the vertical straight wall type noise barrier. The comparison proved that the Y-type noise barrier was rather greater in effect of noise attenuation than the vertical straight wall type one.

Also, a noise barrier having a limited height and showing an increased effect of noise attenuation is known from the disclosure in the Japanese Patent Application laid open as a Provisional Publication No. 85921/96. This conventional noise barrier is essentially composed of a main soundproof wall body extends upright from the ground, first and second additional screens provided on the top of the main wall body, the first additional screen being inclined toward a noise source while the second one is inclined away from the noise source. The first and second additional screens are provided thereon further additional screens, respectively, directed in different directions from those of the first and second additional screens, respectively. When this noise barrier structure is viewed from its lateral end, it looks like horns of a caribou. The noise barrier is called caribou-horn type. The caribou horn-type noise barrier structure can attenuate noise more effectively than the upright straight wall type and top-bent or -curved type noise barriers on the assumption that they have a same height.

The Y-type and caribou horn-type noise barriers can attenuate noise effectively with no increase of their height. Because of their complicated geometry such as their open-top design, however, these noise barriers are difficult to transport and install. Even if the additional screens are adapted for installation on the top of the upright straight main wall body at site, the members included in these noise barriers need a wide space for storage and transport, which will lead to a poor efficiency of installation and a greater total cost.

SUMMARY OF THE INVENTION

The present invention has an object to overcome the above-mentioned drawbacks of the prior art by providing a noise barrier capable of attenuating noise with an improved effectiveness and without any increase of its height, and designed for the necessity of no large space for storage and transport, which leads to a low cost.

The above object can be attained by providing a noise barrier including upright-standing support columns spaced a predetermine distance from each other and each made of an H section, and a plurality of wall panels provided between two neighboring ones of the support columns by inserting each wall panel at opposite lateral edges thereof from above into U-shaped recesses, opposite to each other, of the support columns, the plurality of wall panels being thus stacked one on another to form a main soundproof wall, and a noise control module to be installed on the topmost wall panel, the noise control module comprising:

side frame members to be inserted at lower ends thereof from above into the upper portions of the U-shaped recesses, opposite to each other, of the support columns;

a lower frame member connecting the side frame member to each other by securing them at lower ends thereof to the lower frame member;

first and second additional screens installed at lower ends thereof pivotably to the lower frame member and having a horizontal length smaller than the distance between the support columns;

a coupling member holding the first and second additional screens at a predetermined angle of inclination when the additional screens are inclined toward and away from a noise source, respectively; and sound insulation joint sheets elastically extensible horizontally and bridging, over the support column, two additional screen put in neighboring relationship when the first and second additional screens are opened away from each other.

BRIEF DESCRIPTION OF THE DRAWINGS

These and other objects and advantages of the present invention will be better understood from the ensuing description made, by way of example, of the preferred embodiments of the present invention with reference to the drawings.

DETAILED DESCRIPTION OF THE PREFERRED EMBODIMENTS

Figure 1:
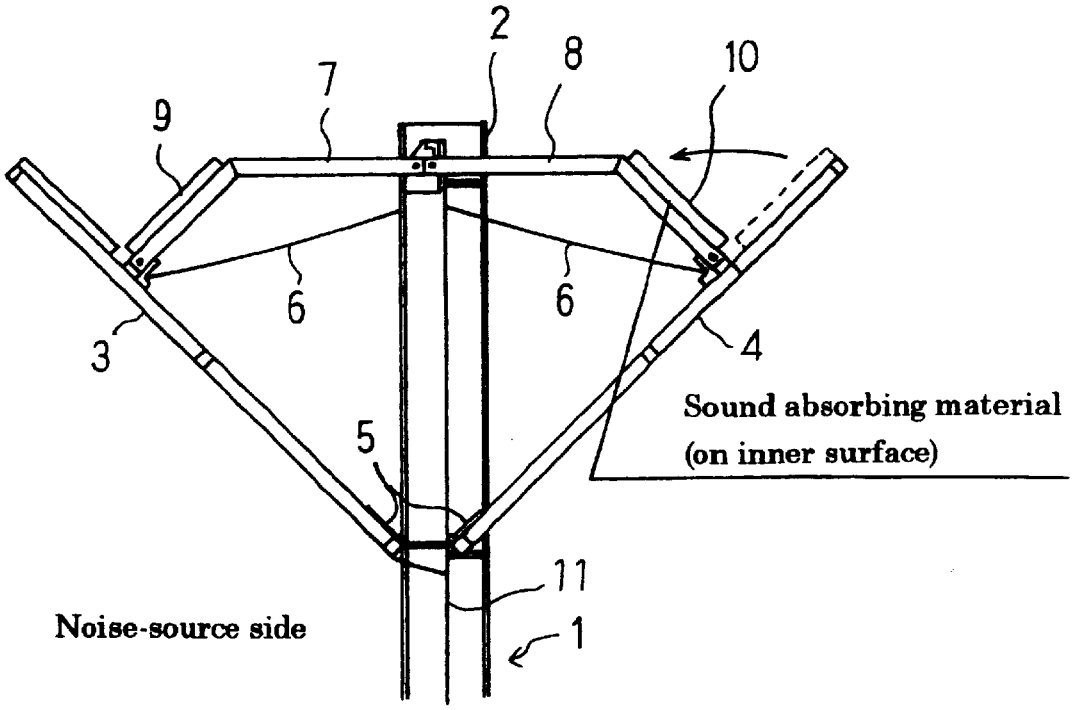
FIG. 1 is a side elevation of a first embodiment of the noise barrier according to the present invention, showing the upper end portion of the noise barrier structure.

FIG. 1 shows the first embodiment of the noise barrier according to the present invention, comprising essentially a main soundproof wall 1, support columns 2 forming a part of the main wall 1, first additional screen 3 tiltable toward a noise source and a second additional screen 4 tiltable away from the noise source, the first and second additional screens 3 and 4 being installed to the support columns 2. The first and second additional screens 3 and 4 are installed pivotably to a mount frame 11 with hinges 5. The mount frame 11 is installed to the upper end of the main wall 1. Coupling members 7 and 8 are provided to hold both the first and second additional screens 3 and 4 inclined to predetermined angles, respectively. The coupling members 7 and 8 are fixed at one end thereof to the first and second additional screens 3 and 4, respectively and at the other end to the mount frame 11. In the illustrated embodiment, safety catches 6 made of a wire rope are provided between the mount frame 11 and both the additional screens 3 and 4, respectively. The coupling members 7 and 8 have first and second further additional screens 9 and 10 provided thereon, respectively.

Figure 2:
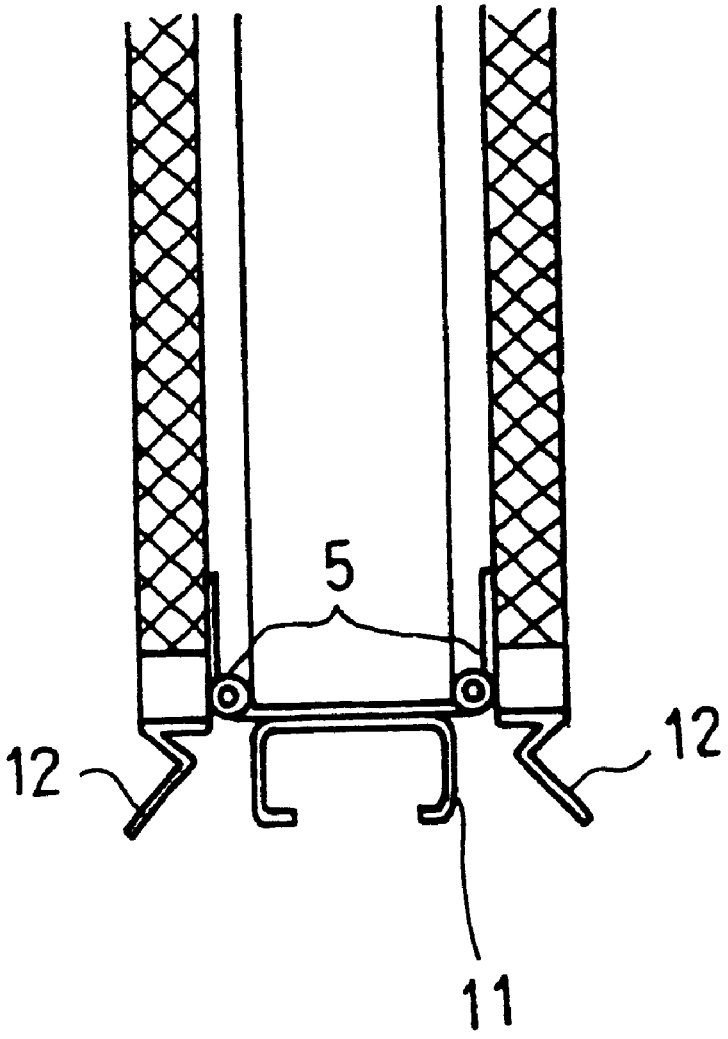
FIG. 2 is a side elevation, enlarged in scale, of the lower end portion of additional screens which are closed, of the noise barrier in FIG. 1.

FIG. 2 is a side elevation, enlarged in scale, of the lower end of the first and second additional screens 3 and 4 in closed position. The hinge 5 are secured to the mount frame 11 extending between the support columns 2. The additional screens 3 and 4 are provided at the lower end thereof, respectively, with an abutment 12 that is made of rubber and abuts on the mount frame 11 when the additional screens 3 and 4 are opened.

Figure 3:
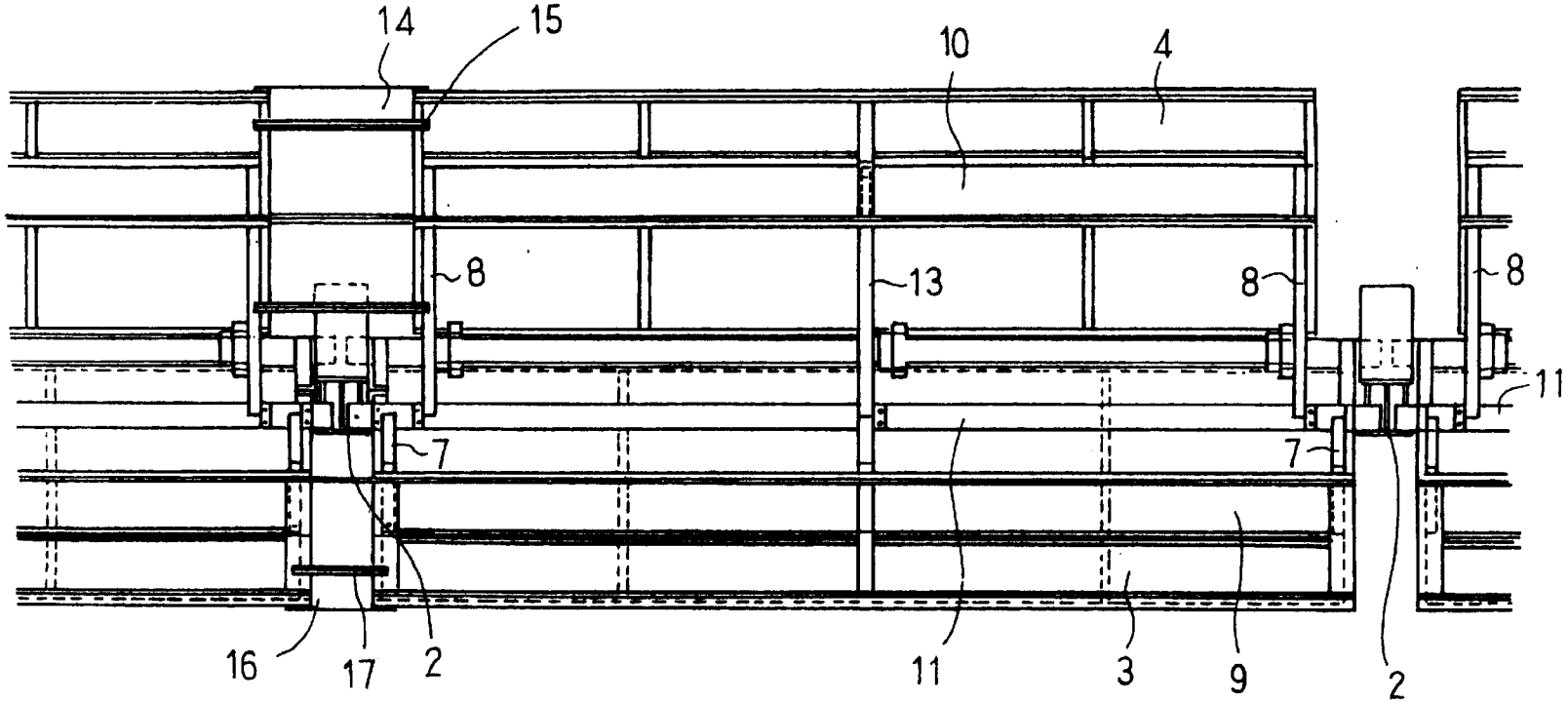
FIG. 3 is a top plan view of the noise barrier in FIG. 1.

FIG. 3 is a top plane view of the completely assembled noise barrier. As shown, the mount frame 11 is installed between the support columns 2, the hinges 5 at the lower ends of the first and second additional screens 3 and 4 are fixed to the mount frame 11, and a cleat 13 is provided in the intermediate position between the support columns 2. Also, a sound insulation joint sheet 14 is attached to the neighboring first additional screens 3 using a joint piece 15, and another sound insulation joint sheet 16 is fixed between the neighboring second additional screens 4 using a joint piece 17.

Figure 4:
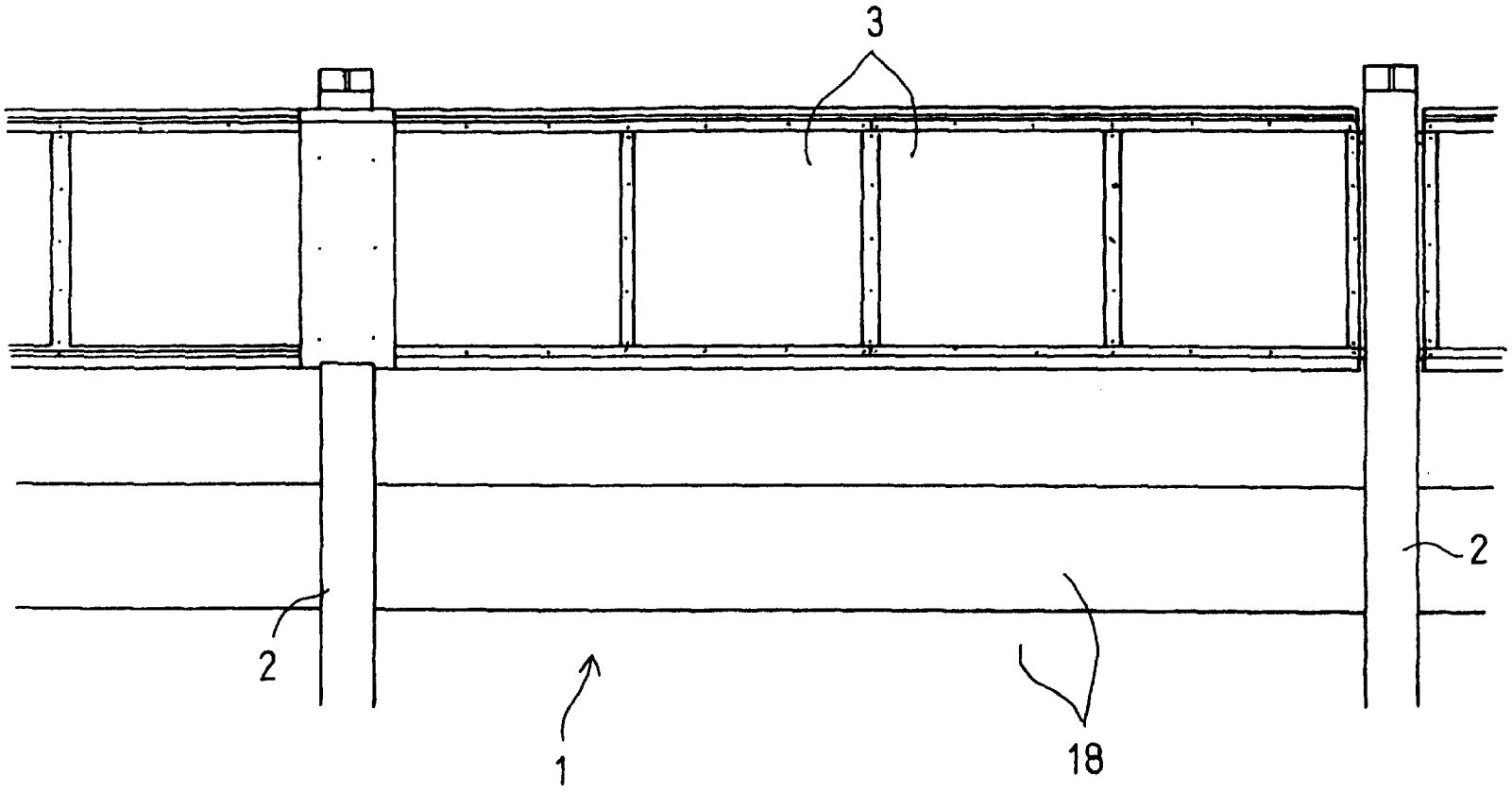
FIG. 4 is a front view, from a noise source, of the noise barrier in FIG. 1.

FIG. 4 is a front view of the noise barrier from the noise source. As shown, wall panels 18 are fixed between the neighboring support columns 2 made of an H section to form together the main soundproof wall 1. The first and second additional screens 3 and 4 are provided on the top of the main wall 1.

Figure 5:
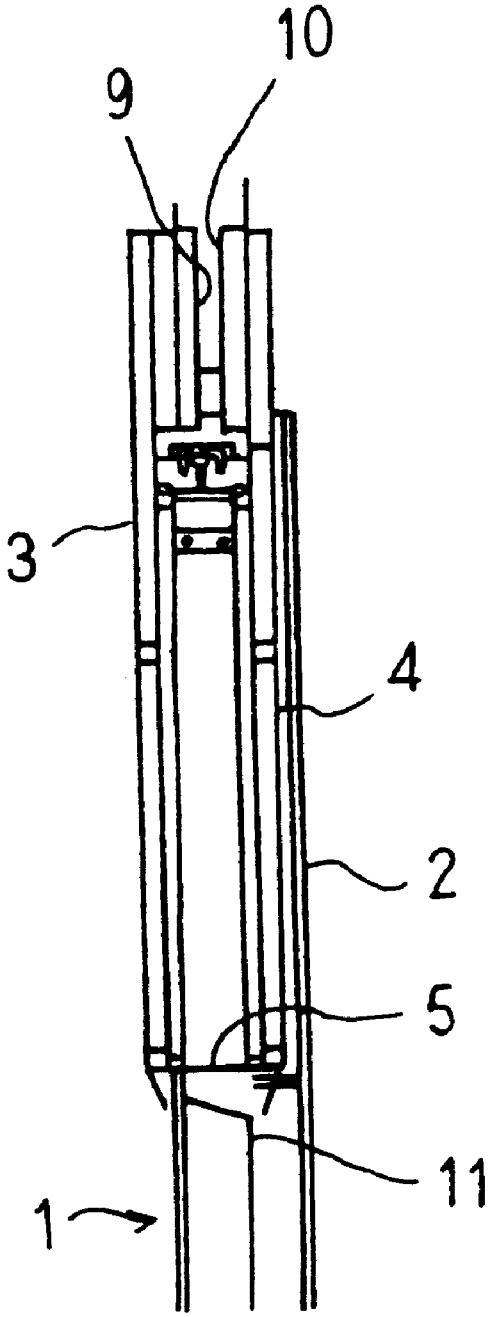
FIG. 5 is a side elevation of the noise barrier in FIG. 1, showing the installation of the additional screens at the lower ends thereof to the top of a mount frame, the additional screens being in closed position.

FIGS. 5 through 8 show the positions the additional screens 3 and 4 take, ranging from their closed position to the installed position on the top of the main wall 1. In FIG. 5, the first and second additional screens 3 and 4 are in closed position and the first and second further additional screens 9 and 10 are folded to the first and second additional screens 3 and 4. In this closed position, the coupling members 7 and 8, sound insulation joint sheets 14 and 16, and joint pieces 15 and 17 are put inside the additional screens 3 and 4 for storage and transport of the noise barrier. Thus, the additional screens require no large space, which leads to reduced costs for storage and transport.

Figure 6:
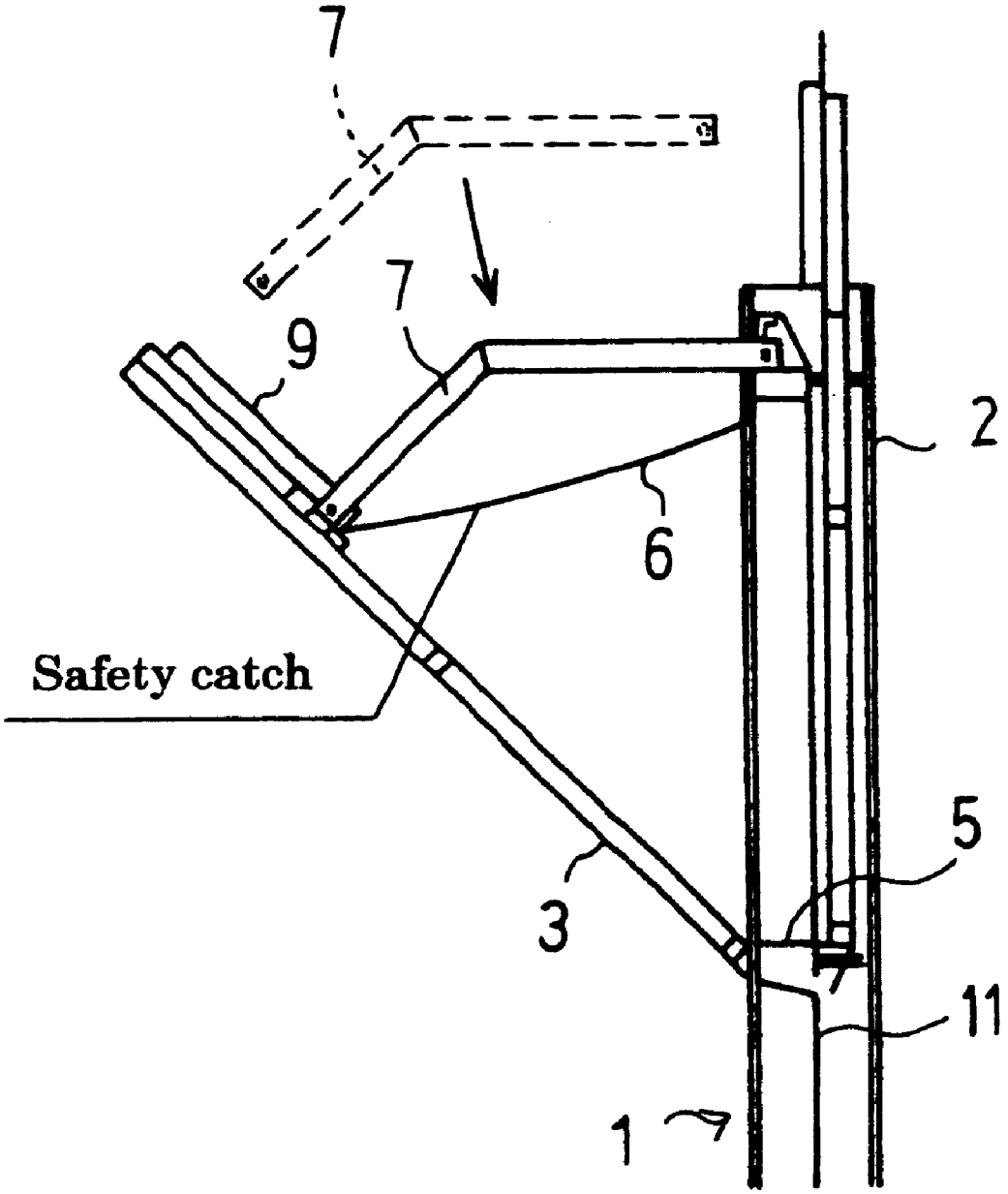
FIG. 6 is a side elevation of the noise barrier in FIG. 1, showing the one, in opened position, of the additional screens that is to face a noise source.
Figure 7:
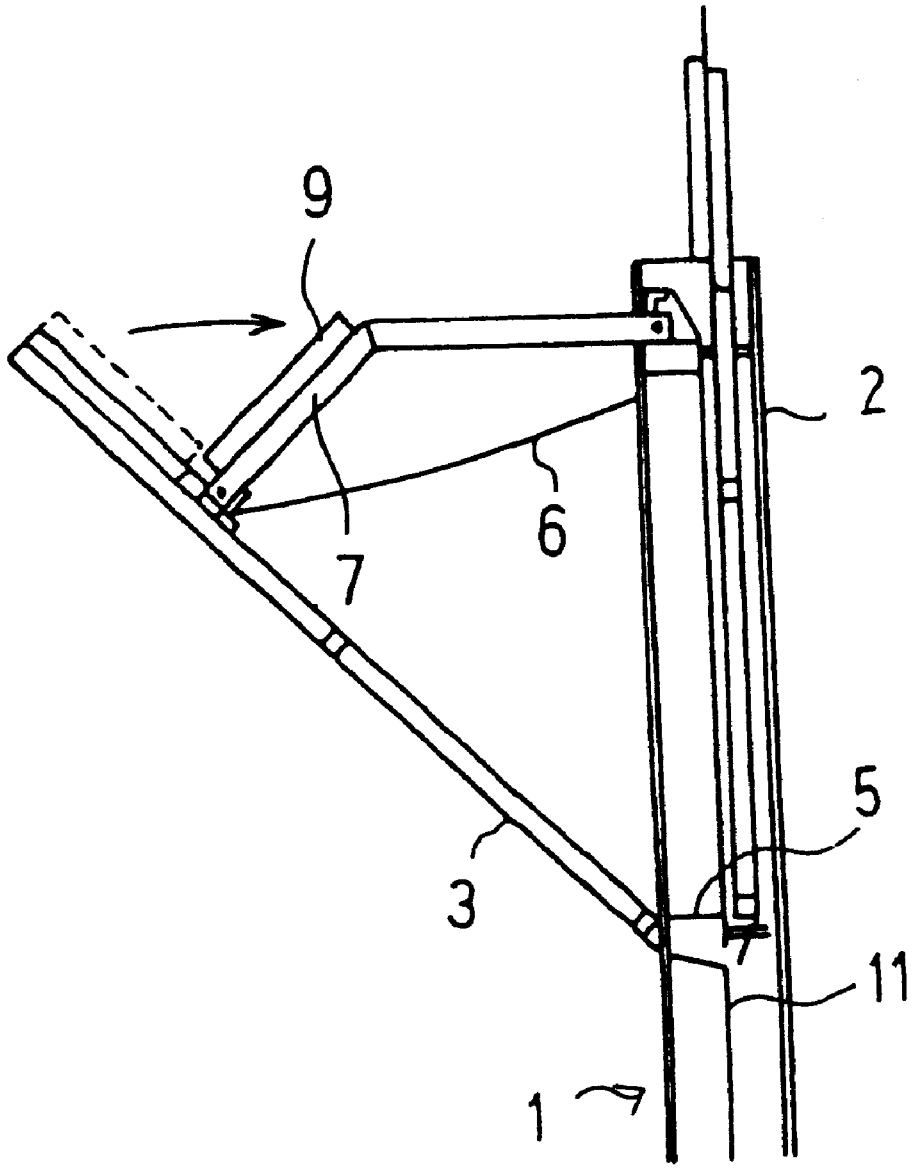
FIG. 7 is a side elevation of the noise barrier in FIG. 1, showing the connection of the one, facing the noise source, of the additional screens to a support column by a coupling member and the installation of an further additional screen to the coupling member.

As shown in FIG. 6, the first additional screen 3 is opened or inclined toward a noise source and the coupling member 7 is installed between the support column 2 and additional screen 3. In this condition in FIG. 6, the first further additional screen 9 is taken from on the additional screen 3 and installed to the coupling member 7. FIG. 7 shows the additional screen 3 and first further additional screen 9 fixed in place at the front side of the noise barrier facing the noise source.

Figure 8:
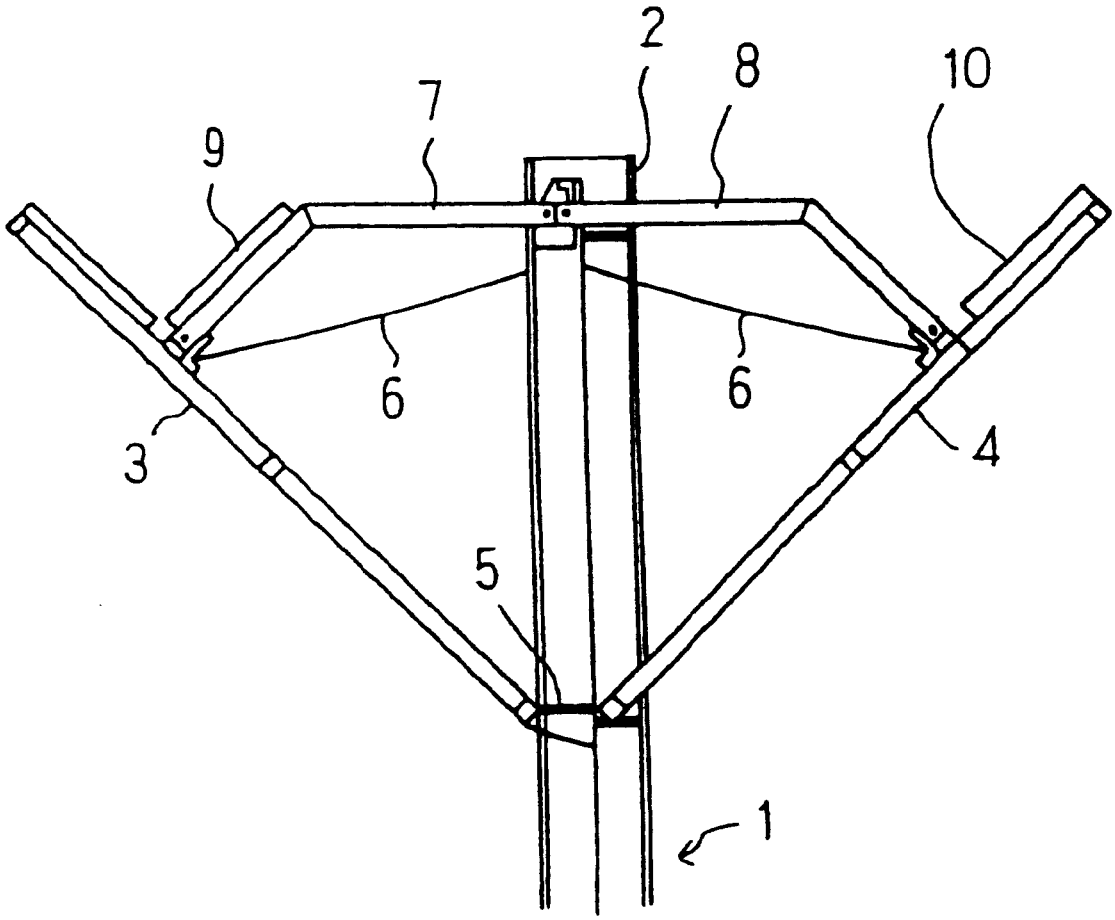
FIG. 8 is a side elevation of the noise barrier in FIG. 1, showing both the additional screens facing and not facing the noise source in opened position.

FIG. 8 shows the second additional screen 4 opened and inclined away from the noise source. The second further additional screen 10 is taken from on the second additional screen 4 and installed to the coupling member 8. The second additional screen 4 and second further additional screen 10 are thus set in place at the opposite side of the noise barrier to the noise source.

Figure 9:
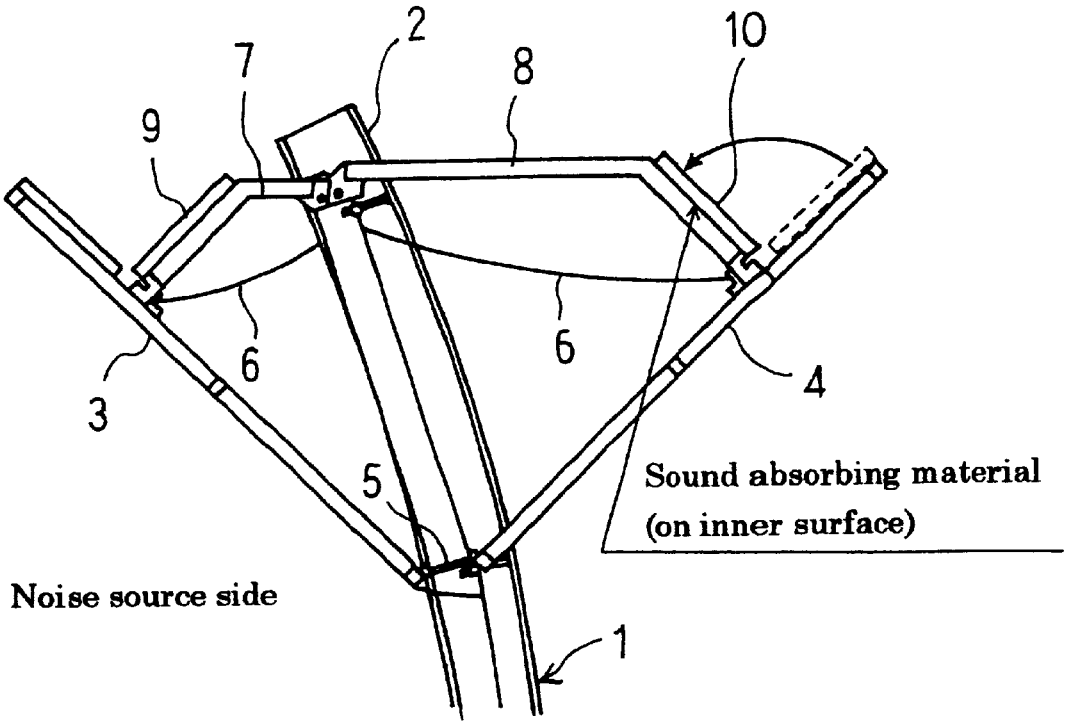
FIG. 9 is a side elevation of a variant of the noise barrier in FIG. 1, in which a modified support column is used.

FIG. 9 shows a variant of the first embodiment of the noise barrier according to the present invention, in which the support column 2 is slightly inclined or curved toward the noise source.

The wall panel 18 shown in FIG. 4 is formed from a combination of rock wool, glass wool or the like and iron sheet, aluminum sheet or the like. The additional screens 3 and 4 have attached thereon each a sound absorbing material (shown as cross-hatched in FIG. 2). The sound absorbing material may be a one selected among formed fiber block, rock wool, glass wool, ceramic, foamed concrete, etc. For fixing the sound absorbing material, bolt, pin, adhesive, porous panel, wire mesh or the like is selectively used depending upon the nature of the sound absorbing material. A similar sound absorbing material may be used on the first and second further additional screens 9 and 10, and the main wall 1.

For this experiment, there were prepared an upright straight wall type of noise barrier comprising only a main soundproof wall 1 of 2.5 m in height and having the first and second further additional screens 9 and 10 not provided thereon, a Y-type noise barrier of 2.5 m in height and having two additional screens 3 and 4 provided thereon, and a Y-type noise barrier structure having the first and second further additional screens 9 and 10 provided thereon, and each of them was erected along a road for evaluation of the effect of noise control of these noise barriers. In this experiment, a speaker was placed in a position on a road 4.5 m off each of the noise barriers to generate each of sounds of 250 Hz, 500 Hz, 1 kHz, 2 kHz and 4 kHz in octave band. A microphone was placed behind the noise barrier. It was positioned 20 m off the edge of the road and at a height of 1.2 m above the ground to measure the sound coming from the speaker. The Y-type noise barrier showed noise attenuation higher by 1, 3, 4, 4 and 4 dB (for the octave-band sounds, respectively) than those by the noise barrier of upright straight wall type. The Y-type noise barrier with the first and second further additional screens 9 and 10 provided thereon showed noise attenuation higher by 2, 5, 6, 6 and 6 dB than those by the upright straight wall type noise barrier. The noise barriers having the sound absorbing material used thereon showed higher effects of noise control.

As having been described in the foregoing, since the noise barriers according to the present invention comprise the main wall rising upward from the ground, the first additional screen provided on the top of the main wall and inclined toward a noise source, and the second additional screen also provided on the top of the main wall and inclined away from the noise source. The lower ends of the first and second additional screens are fixed to the mount frame with the hinges in such a manner that they can be opened and closed. The hinges of the first and second additional screens in closed position are fixed to the upper end of the main wall. Each of the first and second additional screens is held opened or inclined by the coupling members at predetermined angles, and the additional screens may be closed until installed at site, which thus need no wide space for storage and transport and can be easily stored and transported. Therefore, the storage and transport do not cost much. Also, the noise barrier according to the present invention can be installed by following the steps of erecting support columns made each of an H section at predetermined intervals on the ground and fixing wall members between the support columns to form the main wall, bridging the support columns by the mount frame extending over the upper end of the top one of the wall members, fixing the lower ends of the first and second additional screens to the mount frame with the hinges, inclining the first and second additional screens to predetermined angles, and holding, at the angles of inclination, both the additional screens each with coupling members. Therefore, the components of the noise barrier according to the present invention need no wide space for storage and transport, and thus low costs can be attained for the storage and transport. Also the noise barrier according to the present invention can be easily installed.

Next, the second embodiment of the noise barrier according to the present invention will be described herebelow with reference to FIGS. 10 to 22.

Figure 10:
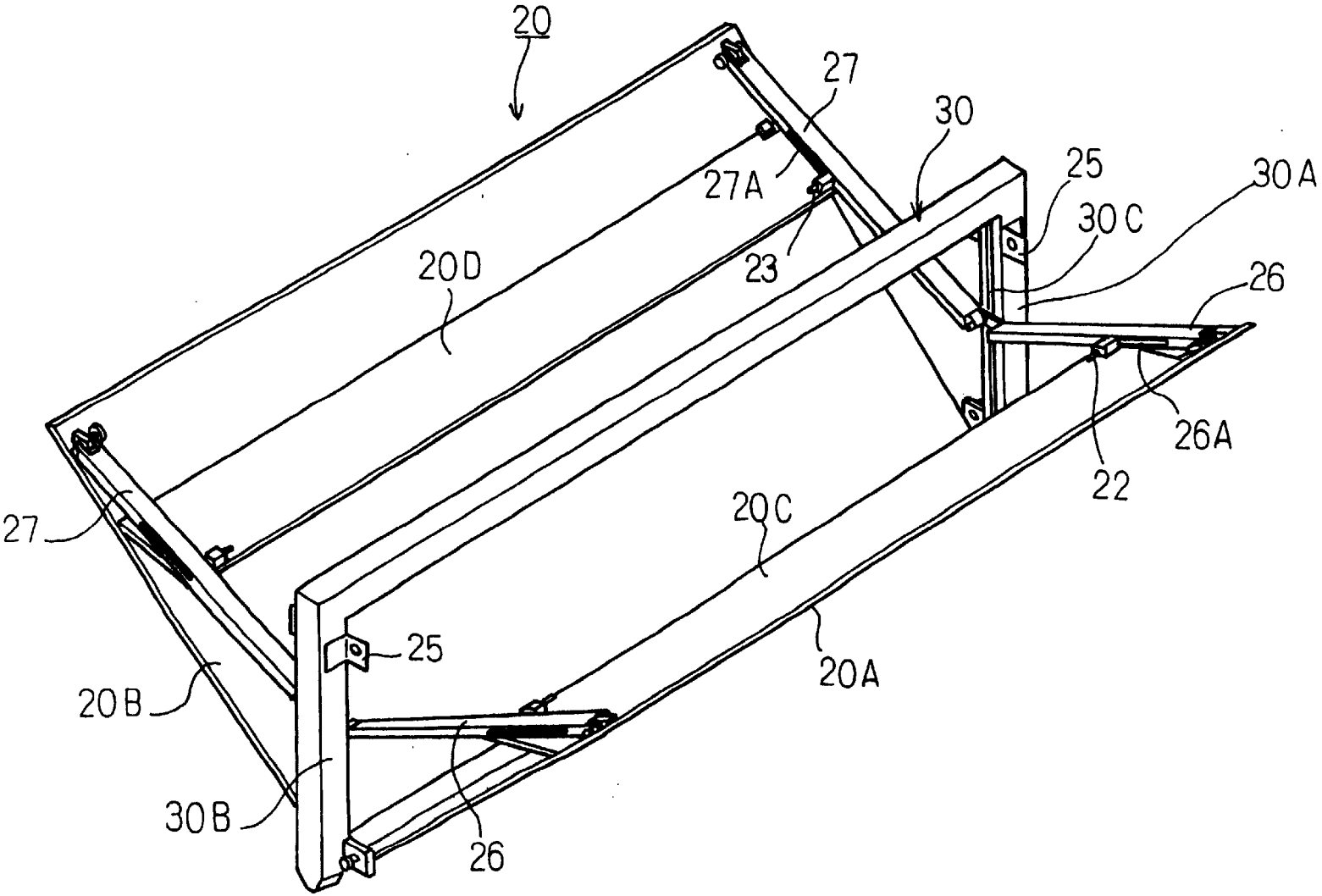
FIG. 10 is a perspective view of a noise control module for the noise barrier according to the present invention.

FIG. 10 shows a noise control module 20 of the noise barrier, comprising a main frame 30 positioned in the center of the noise control module 20 and having a rectangular shape and a pair of tilting panels 20A and 20B installed at a base end thereof pivotably to the bottom of the main frame 30. The main frame 30 includes vertical portions 30A and 30B each having a vertical guide recess 30C formed therein. There is provided a pair of arms 26 and 27 each installed at one end thereof pivotably to an end portion of each of the pair of tilting panels 20A and 20B, and at the other end thereof in the guide recess 30C.

Thus, the pair of tilting panels 20A and 20B can be pivoted toward the main frame 30. When the other end of each of the arms 26 and 27 is moved up to the upper end of the guide recess 30C, the tilting panels 20A and 20B are opened away from the main frame 30, thus forming additional screens. Furthermore, there are provided elongated panels 20C and 20D extending on the inside surfaces, and over the width, of the tilting panels 20A and 20B, respectively, and installed at base ends thereof pivotably to the tilting panels 20A and 20B, respectively. The elongated panels 20C and 20D are connected at other ends thereof pivotably to pins 22 and 23, respectively, movable in slots 26A and 27A, respectively, formed in the arms 26 and 27, respectively.

As the tilting panels 20A and 20B are folded, the pins 22 and 23 are moved in the slots 26A and 27A, respectively, toward the main frame 30, the elongated panels 20C and 20D are tilted toward the tilting panels 20A and 20B, respectively, and finally overlap on each other. On the contrary, when the tilting panels 20A and 20B are opened away from each other, the pins 22 and 23 are moved in the slots 26A and 27A, respectively, away from the main frame 30, the elongated panels 20C and 20D are thus raised from the tilting panels 20A and 20B, respectively, to thus form the respective further additional screens. FIG. 10 shows the noise control module 20 being opened to the mid way.

Figure 11:
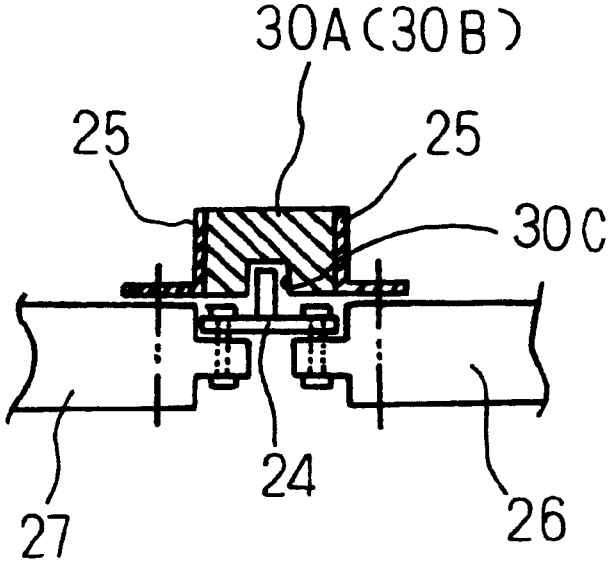
FIG. 11 is a partially sectional plan view showing the relationship between arms and a guide recess.

FIG. 11 shows the relationship between the arms 26 and 27 and the guide recess 30C. A rail member 24 is secured pivotably to the other ends of the arms 26 and 27. The rail member 24 has a projection inserted in the guide recess 30C. The main frame 30 has secured on opposite sides of the vertical portion 30A thereof hinges 25 to which the arms 26 and 27 are to be fixed at the other ends thereof with bolts or the like with the tilting panels 20A and 20B fully opened.

Figure 12:
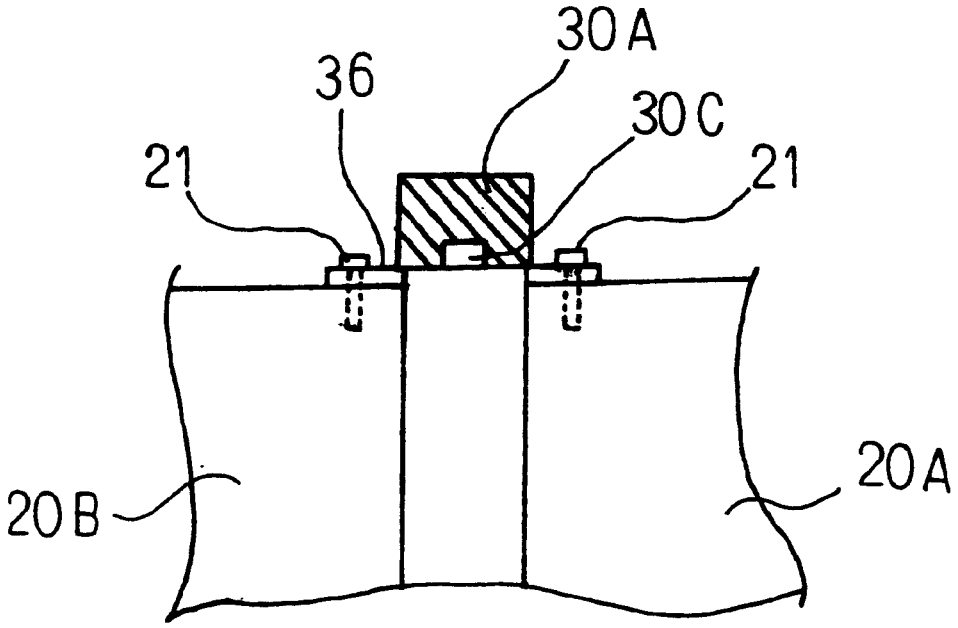
FIG. 12 is a top plan view showing, by way of example, the installation of tilting panels at base ends thereof to a main frame.

FIG. 12 shows, by way of example, the installation of the tilting panels 20A and 20B at the base ends thereof to the main frame 30. A fixing plate 36 is provided under the main frame 30. The tilting panels 20A and 20B are coupled at the base ends thereof to the fixing plate 36 with pins 21.

Figure 13:
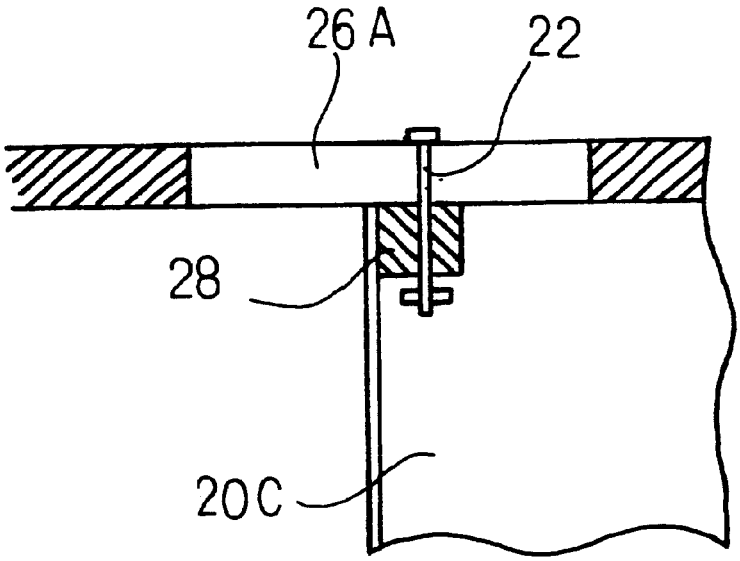
FIG. 13 is a sectional view showing, by way of example, the installation of an elongated panel.

FIG. 13 shows the relationship between the elongated panels 20C and 20D and the slots 26A and 27A formed in the arms 26 and 27, respectively. There is only shown the relationship between the elongated panel 20C and slot 26A, but it should be noted that a same relationship exists between the other elongated panel 20D and slot 27A. A pin 22 is provided movably inside the slot 26A and penetrated at one end portion thereof through a fixture 28 provided on the elongated panel 20C. The pin 22 is freely rotatable in the fixture 28 but not axially disengageable from the fixture 28.

Figure 14:
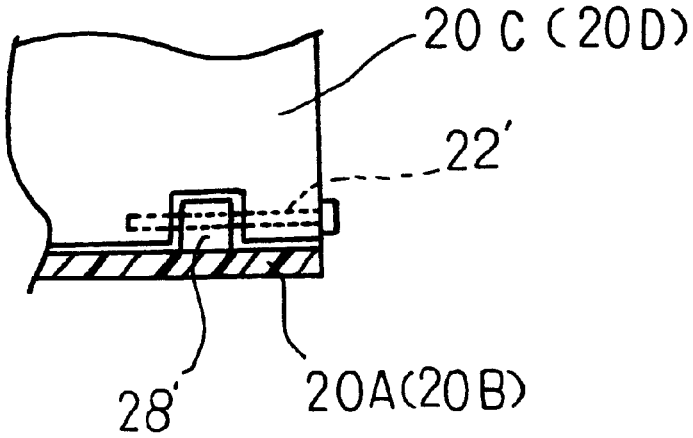
FIG. 14 is a sectional view showing, by way of example, the installation of the elongated panel to the tilting panel.

FIG. 14 shows an example of the pivotal mechanism of the base ends of the elongated panels 20C and 20D. Each of the tilting panels 20A and 20B has a fixture 28' formed therein while each of the elongated panels 20C and 20D has formed in the base end thereof a cut corresponding to the fixture 28'. The base end of the elongated panel 20C (20D) and fixture 28' of the tilting panel 20A (20B) have formed holes therein. When the elongated panel 20C is set in place with the fixture 28' of the tilting panel 20C in the cut in the elongated panel 20C, the holes are aligned with each other. A pin 22' is introduced through these aligned holes. Thus, after completion of this assembling, the elongated panel 20C (20D) is pivotable in relation to tilting panel 20A (20B). It should be noted that the arms 26 and 27 are also coupled at one end thereof to the tilting panels 20A and 20B, respectively, in the same manner as in FIG. 14.

Figure 15:
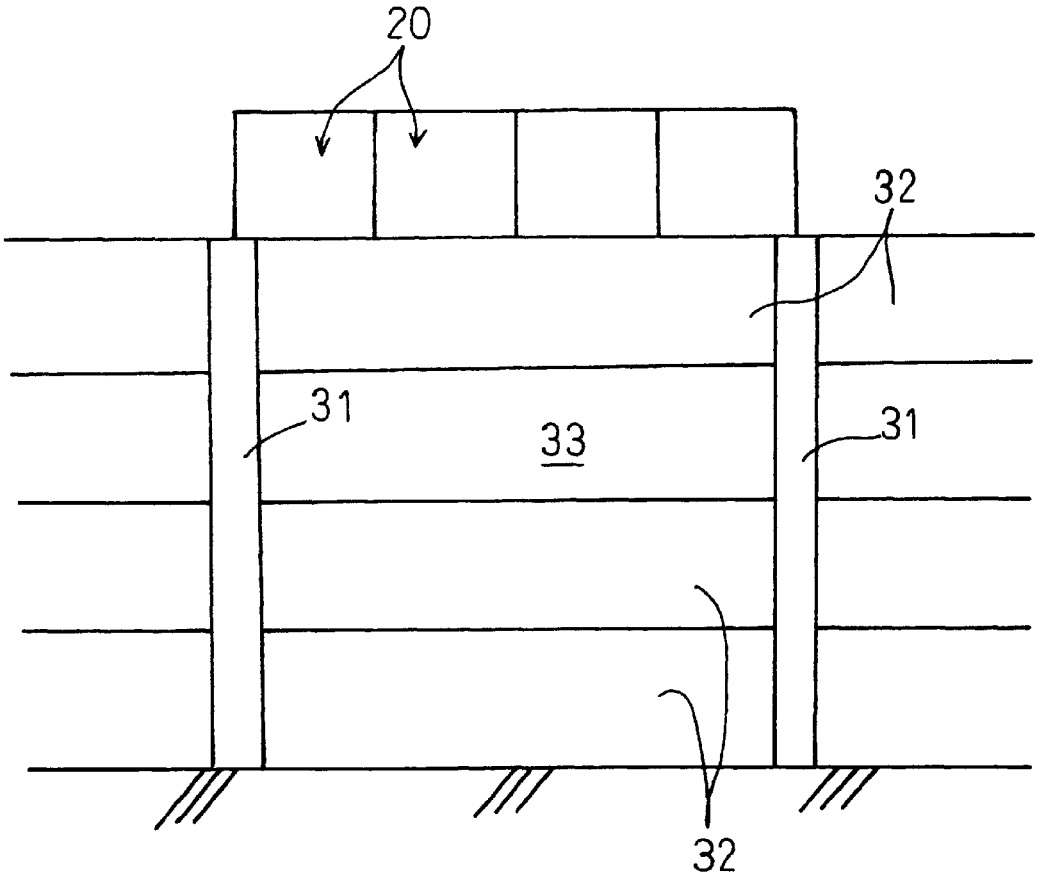
FIG. 15 is a front view of the noise barrier having the noise control module in FIG. 10 installed on the main wall.

FIG. 15 is a front view of the noise barrier on which the noise control module is installed. As shown, wall panels 32 are installed between support columns 31 erected at predetermined intervals to form a main wall 33. A plurality of the noise control modules 20 is installed side by side on the top of the main wall 33. The support columns 31 are made of an H section. The wall panels 32 are stacked one on another between the support columns 41 by inserting each wall panel 32 at opposite lateral ends thereof from above into U-shaped recesses, opposite to each other, of the support columns 31. Thus the main wall 33 is formed. The noise control modules 20 are disposed side by side and coupled to each other longitudinally of the main wall 33, and they are installed on the tops of the support columns 31.

Figure 16:
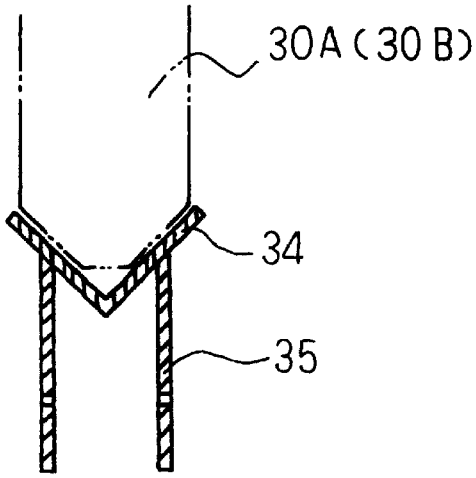
FIG. 16 is a sectional view showing a fixture for the noise control module in FIG. 10.

FIG. 16 is a sectional view showing a fixture with which the vertical portions 30A and 30B of the main frame 30 of the noise control module 20 are secured to the top of the support columns 31. The fixture comprises a V-shaped metallic member 34 having a generally V cross section and extending between the support columns 31, and legs 35 provided at opposite ends of the V-shaped metallic member 34 and which are to be secured to the support columns 31 (H section).

By forming the noise control module 20 from a plastic material by injection molding or otherwise, a large number of noise control modules 20 can be provided inexpensively. Besides the plastic material, a metallic material such as stainless steel, aluminum or the like may be used to form the noise control module 20. Furthermore, a sound absorbing material may be provided on the outer surface of the tilting panels 20A and 20B and on the inner surface of the elongated panels 20C and 20D.

Figure 17:
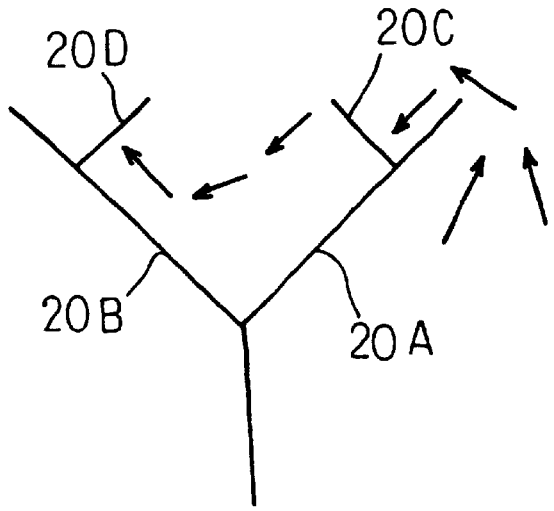
FIG. 17 is a sketch for explanation of the sound propagation taking place around the noise control module in FIG. 10 mounted on the main wall of the noise barrier.
Figure 18:
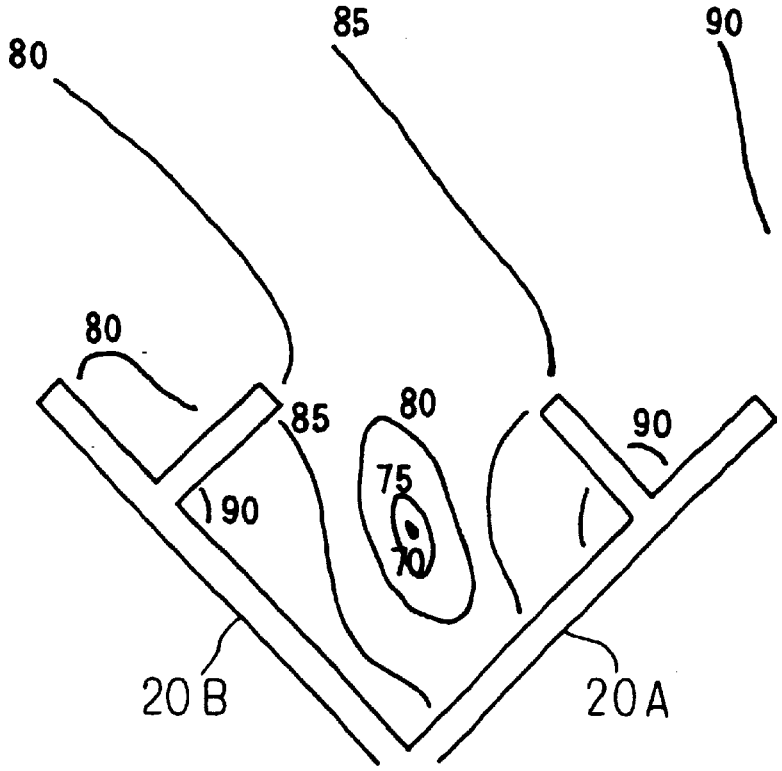
FIG. 18 is a map of sound pressures around the noise control module in FIG. 10 when a noise takes place.
Figure 19:
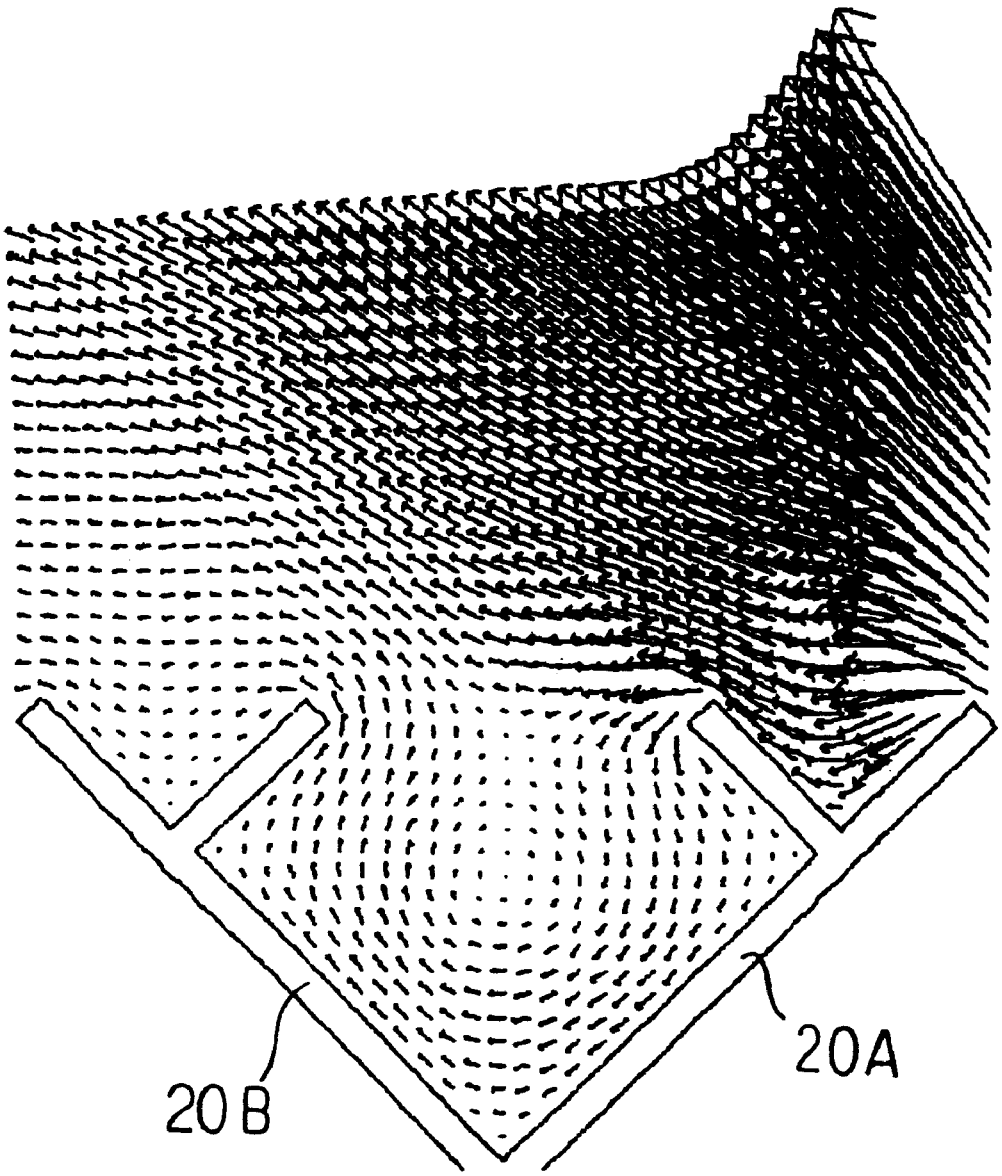
FIG. 19 is a map of sound intensities around the noise control module in FIG. 10.

FIG. 17 is a sketch for explanation of the sound propagation taking place around the noise control modules 20 mounted on the main soundproof wall 33. As seen, the existence of the additional screens in the present invention suppresses diffracted sound more effectively than with the conventional noise barriers. FIG. 18 is a map of sound pressures (in dB) around the noise control module 20 when applied with a noise in an octave band of 250 Hz. FIG. 19 is a map of sound intensities around the noise control module 20. The arrows in FIG. 19 indicate the flowing directions of acoustic energy and the length of each arrow indicates an extent of acoustic energy. The longer the arrow, the larger the acoustic energy is.

Figure 20:
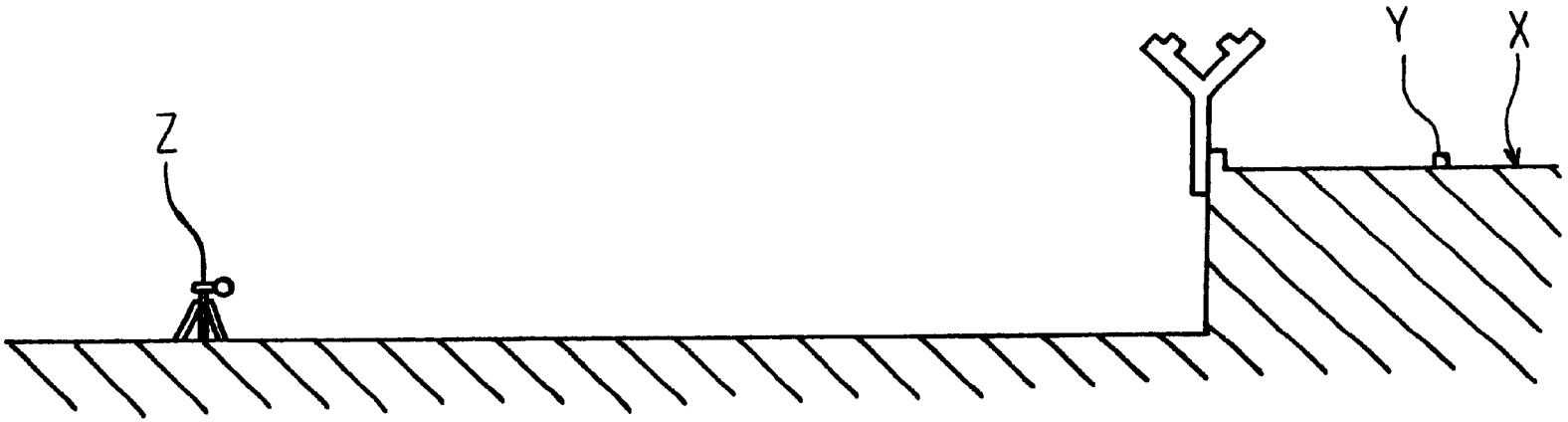
FIG. 20 shows a method of evaluating noise attenuation by the noise barrier in FIG. 10 according to the present invention.

FIG. 20 shows a method of measuring a noise attenuation (in dB) by the noise barrier with the noise control modules 20 installed on the main wall 33. The noise barrier according to the present invention and a conventional upright straight wall type noise barrier as a comparative example were tested on the effect of noise attenuation. Each of the noise barriers was erected over a distance of 100 m along a road X on a mound of 3.5 m in height. A speaker Y was placed at a distance of 4.5 m off the noise barrier. Sounds in octave bands of 250 Hz, 500 Hz, 1 kHz, 2 kHz and 4 kHz were generated from the speaker Y. A microphone Z was placed at a position 20 m off the edge of the road X and at a height of 1.2 m from the ground to measure the level of each sound from the speaker. The conventional noise barrier consisted only of the main soundproof wall 33 having a height of 2.5 m from the ground, and a noise barrier with the noise control modules 20 installed thereon, having a total height of 2.5 m from the ground, was tested as a typical embodiment of the present invention. Attenuation of each sound from the speaker Y by each of the noise barriers was measured. The test results proved that the noise barrier according to the present invention can attenuate the 250 Hz sound by 2 dB, 500 Hz sound by 5 dB, and 1, 2 and 4 kHz sounds by 6 dB more than the conventional noise barrier.

Figure 21:
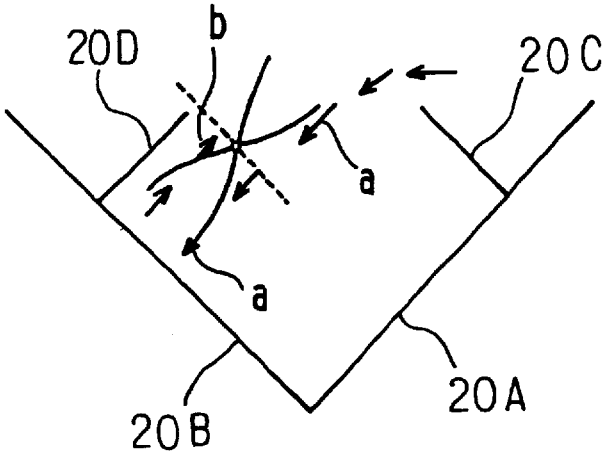
FIG. 21 shows how sound waves interfere with each other inside the noise control module in FIG. 10.
Figure 22:
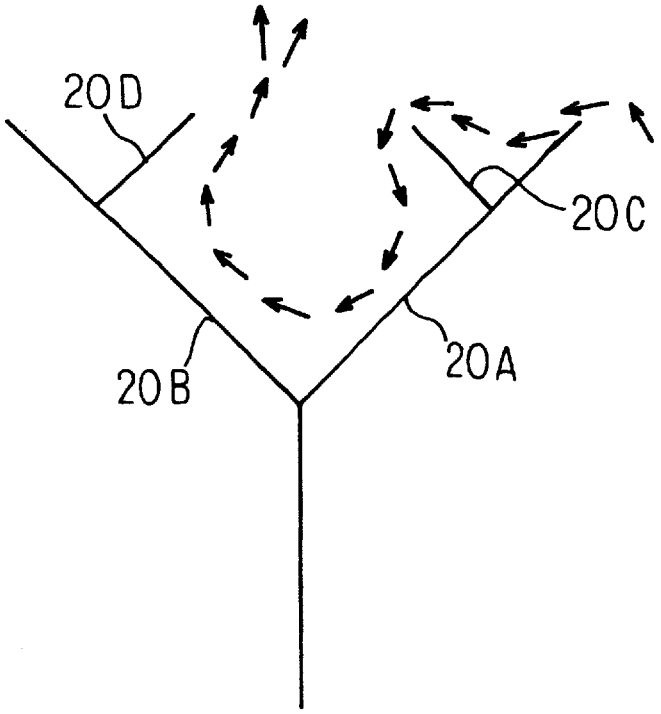
FIG. 22 shows a sound wave vortex taking place inside the noise control module in FIG. 10.

Generally, the lower the sound pressure level at a diffraction point, the weaker the diffracted sound is. FIG. 21 shows how sound waves interfere with each other inside the noise control module. As seen, at the end of the second further additional screen 20D of the second additional screen 20B located on an opposite side of the noise barrier to the sound source (speaker Y), a sound wave a having come around from the sound source interferes with a sound wave b reflected at the second additional screen 20B so that the sound pressure level of a certain frequency is considerably reduced and the final diffracted sound is dramatically reduced. FIG. 22 shows a sound wave vortex taking place inside the noise control module 20. It can be considered that the acoustic energy flow of a certain frequency becomes a vortex directed from the sound receiving point toward the sound source to effectively suppress the sound or noise.

As having been described in the foregoing, the tilting panels of the noise control module according to the second embodiment of the present invention can be folded before installed to the main soundproof wall. Thus, the noise control module can be designed very compact and for easy storage and transport. When installing the noise control module on the top of the main wall at site, the tilting panels are opened to secure the arms to the main frames. Thus, the additional screens can easily be formed. The main frame of the noise control module can be installed simply on the top of the main wall. Since the tilting panels corresponding to the additional screens in the first embodiment and elongated panels corresponding to the further additional screens in the first embodiment are both adapted for free tilting, just opening the tilting panels permits to raise the elongated panels on the tilting panels, which enables an easy and rapid installation of the noise barrier at site.

Next, the third embodiment of the noise barrier according to the present invention will be described herebelow with reference to FIGS. 23 through 30.

Figure 23:
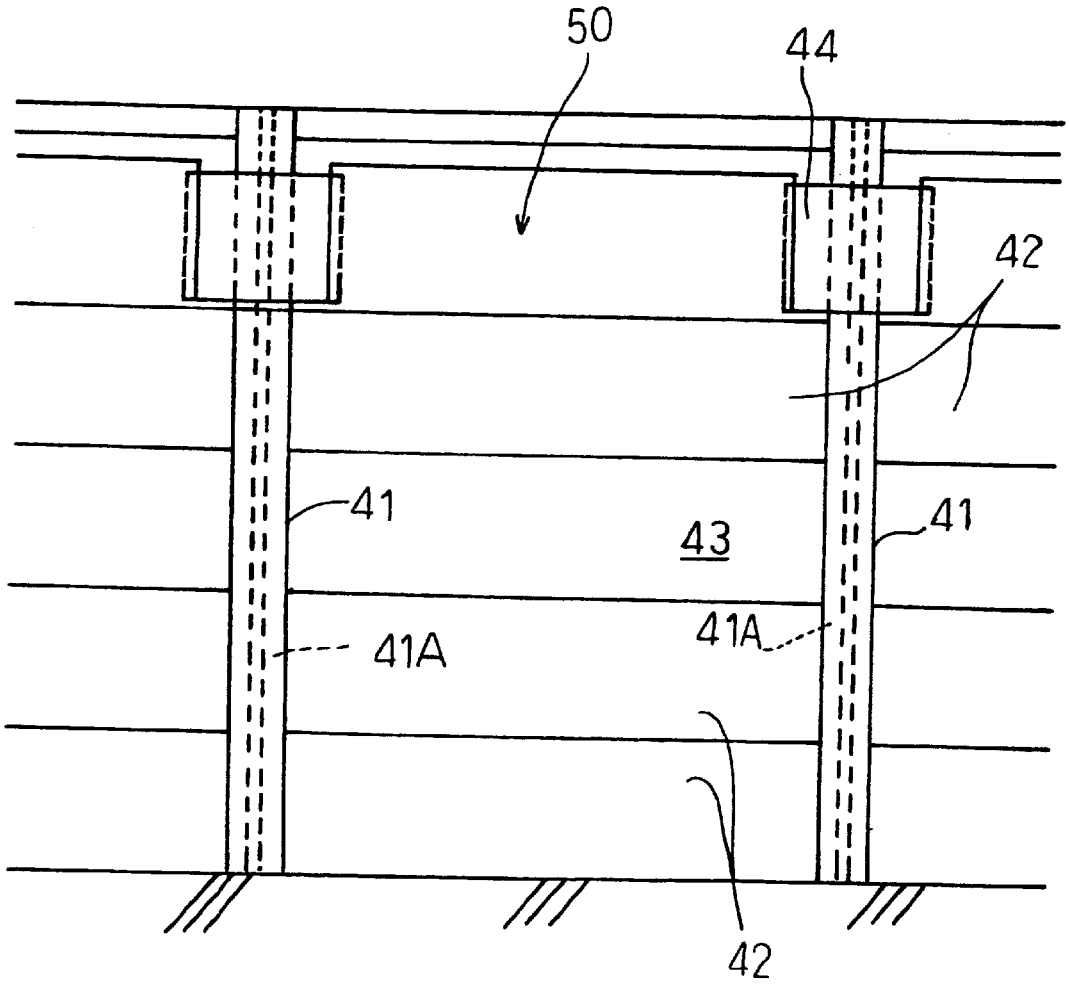
FIG. 23 is a schematic front view of a third embodiment of the noise barrier according to the present invention.

FIG. 23 is a schematic front view, from a noise source, of a third embodiment of the noise barrier according to the present invention. In this case, the noise source is a highway, for example. As shown, the noise barrier comprises support columns 41 made of an H section and erected at predetermined intervals, and main soundproof wall 43 formed from a plurality of wall panels 42 provided between two neighboring ones of the support columns 41 by inserting each wall panel 42 at opposite lateral ends thereof from above into U-shaped recesses, opposite to each other, of the support columns 41. The pluralities of wall panels 42 are thus stacked one on another to form the main wall 43. The noise barrier according to the third embodiment further comprises noise control modules 50 (see FIG. 24) each having side frame members 51 and installed on the topmost wall panel 42 by inserting the side frame members 51 at lower ends thereof from above into the upper portions of the U-shaped recesses 41A, opposite to each other, of the support columns (41). The neighboring noise control modules 50 are coupled to each other with sound insulation joint sheets 44 over the support columns 41, as will be seen from FIG. 23.

Figure 24:
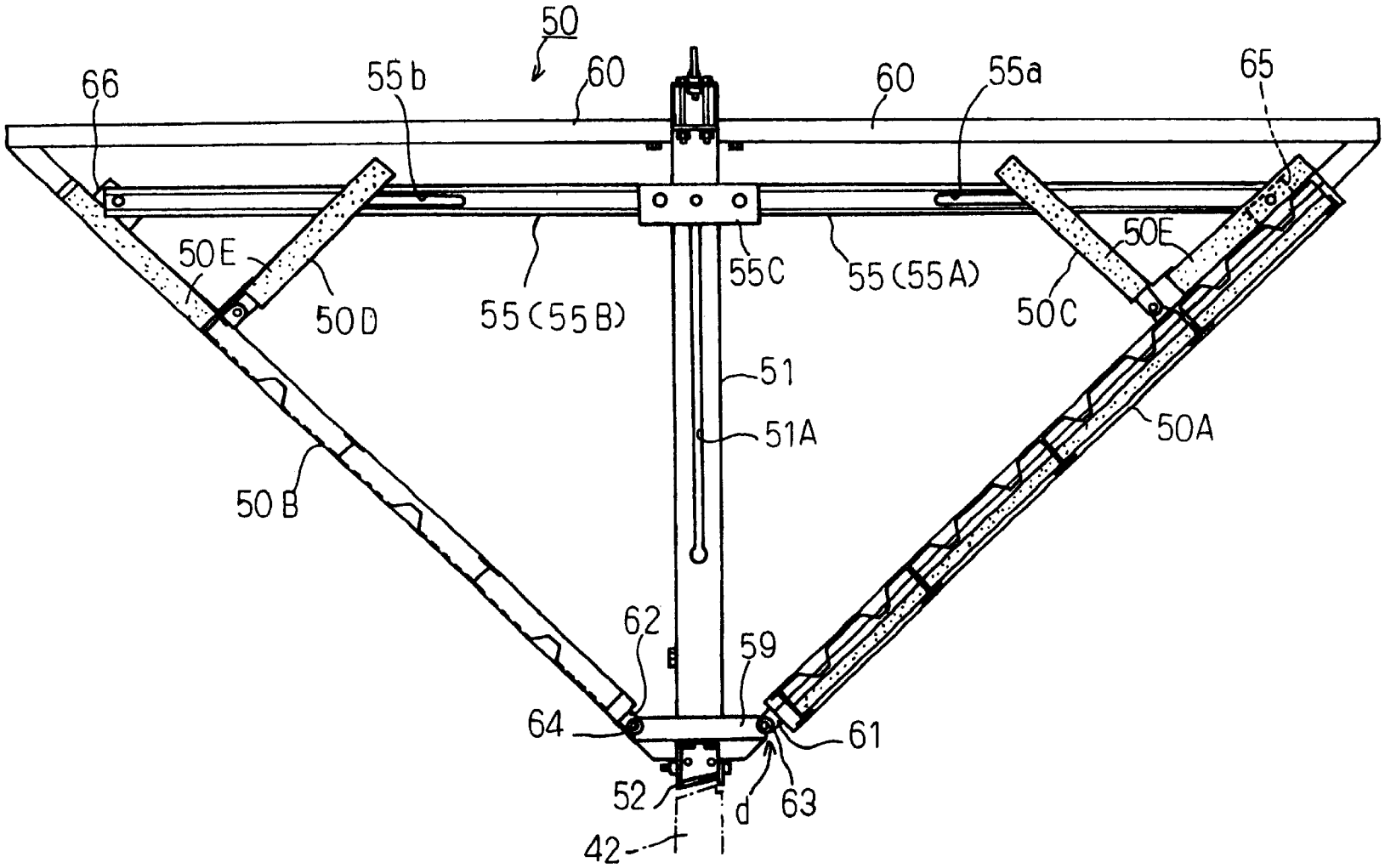
FIG. 24 is a side elevation of the noise control module of the noise barrier in FIG. 23.

FIG. 24 is a side elevation of the noise control module of the noise barrier in FIG. 23. The noise control module 50 comprises side frame members 51 (one of which is shown for the simplicity of illustration) to be inserted into, and secured in, U-shaped recesses 41A of the support columns 41, a lower frame member 52 connecting the side frame members 51 at the lower ends thereof to each other, first and second additional screens 50A and 50B installed at lower ends thereof pivotably to the lower frame member 52, and a coupling member 55 which holds the first and second additional screens 50A and 50B at predetermined angles of inclination when they are opened to incline toward and away from a noise source. The coupling member 55 consists of two arms 55A and 55B installed at one end thereof pivotably to the upper portions, respectively, of the first and second additional screens 50A and 50B, and at the other end thereof pivotably and vertically slidably to the side frame member 51. Advantageously, the arms 55A and 55B of the coupling member 55 can positively hold the first and second additional screens 50A and 50B in their opened positions.

In the embodiment of the noise control module 50 shown in FIG. 24, the first and second additional screens 50A and 50B have provided on the inner surfaces thereof first and second further additional screens 50C and 50D that rise from the inner surfaces of the additional screens 50A and 50B and define a V-shaped space between them and the first and second additional screens 50A and 50B, respectively. The first and second further additional screens 50C and 50D are secured at one end thereof pivotably to the inner surfaces of the first and second additional screens 50A and 50B, respectively, and at the other ends thereof pivotably to the arms 55A and 55B, respectively, forming together a coupling member 55 to be slidable longitudinally of the arms 55A and 55B. There is provided between the lower frame member 52 and lower end of the first additional screen 50A a clearance d that allows the first additional screen 50A to be freely pivotable. The additional screens 50A and 50B are installed to the lower frame member 52 as in the following. Namely, a bracket 59 is fixed to the lower frame member 52, and pivots 63 and 64 are used to connect the bracket 59 to fixtures 61 and 62, respectively, extending from the lower ends, respectively, of the first and second additional screens 50A and 50B. The pivots 63 and 64 may be bolts and fastened with nuts with the first and second additional screens 50A and 50B kept open as shown in FIG. 24.

The side frame member 51 has formed therein vertical slot 51A in which a joint piece 55C is provided to be movable along the slot 51A. The arms 55A and 55B are fixed at the other ends thereof pivotably to the joint piece 55C. The other ends of the arms 55A and 55B may be provided each with a bolt for pivoting thereof. For immobilizing the arms 55A and 55B, the bolt at the other end thereof may be fastened with a nut. Also the joint piece 55C is provided with a bolt for engagement in the slot 51A. For immobilizing the joint piece 55C, the bolt is fastened with a nut to the side frame member 51. The arms 55A and 55B are installed at one end thereof pivotably with bolts to brackets 65 and 66, respectively, provided on the first and second additional screens 50A and 50B. In the status shown in FIG. 24, the nuts are fastened to secure the arms 55A and 55B at one end thereof to the brackets 65 and 66. The arms 55A and 55B have formed therein slots 55*a* and 55*b*, respectively, in which the first and second further additional screens 50C and 50D are installed at the other end thereof pivotably and slidably. A bolt is inserted through each of the slots 55*a* and 55*b*, and provided with a nut at the other end thereof. In the status shown in FIG. 24, the nut is fastened to secure the further additional screens 50C and 50D at the upper portions thereof to the arms 55A and 55B, respectively. After the additional screens 50A and 50B are fixed with each of the pivotable portions locked, a fixing member 60 shown in FIG. 24 is to be provided to connect the side frame member 51 and upper ends of the additional screens 50A and 50B. Further, a sound absorbing member 50E is provided at predetermined places such as on the additional screens 50A and 50B, and further additional screens 50C and 50D.

Figure 25:
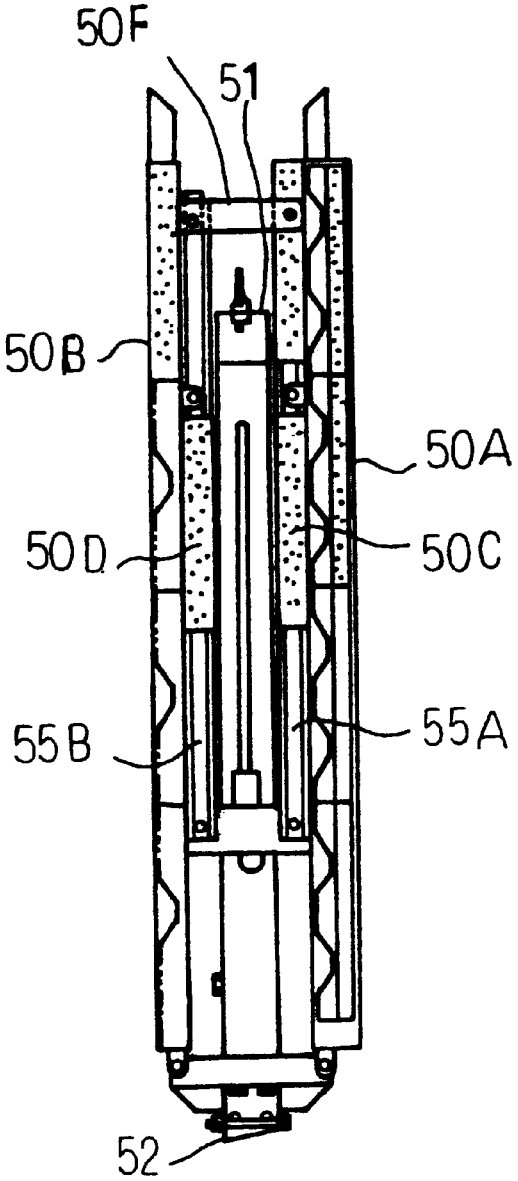
FIG. 25 is a side elevation of the folded noise control module in FIG. 24.

FIG. 25 is a side elevation of the noise control module 50, showing it in the folded position. The arms 55A and 55B, additional screens 50A and 50B, and further additional screens 50C and 50D are all folded to be parallel to the side frame member 51. A retainer 50F is provided to hold these screens in their folded or closed positions.

Figure 26:
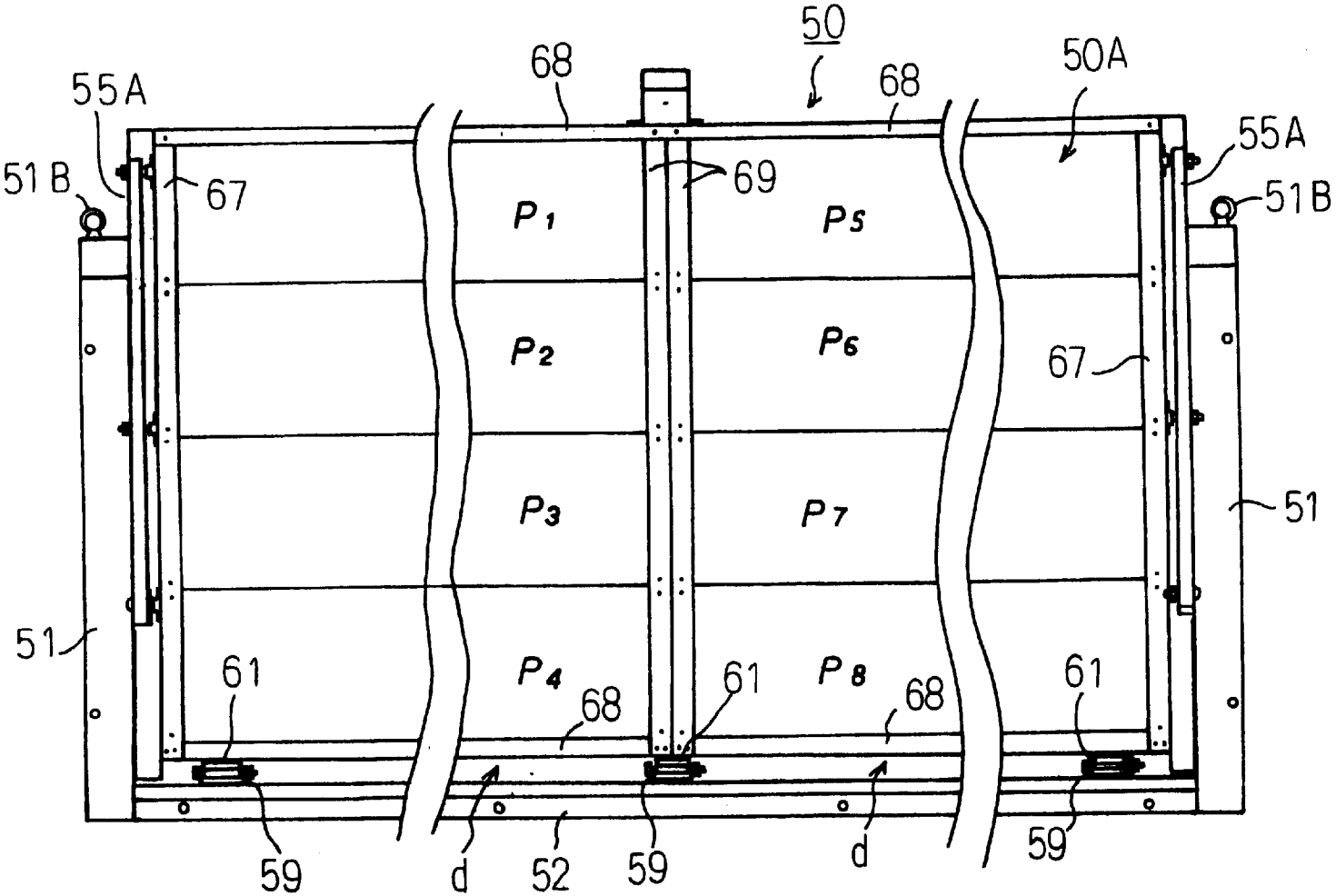
FIG. 26 is a front view of the folded noise control module in FIG. 24.

FIG. 26 is a front view of the folded noise control module 50 in FIG. 25. As seen, each of the additional screens 50A and 50B includes eight screen panels $P_1$ to $P_8$ joined laterally to each other by vertical frames 67 and horizontal frames 68 and joined at the intermediate portions thereof to each other by a vertical joint frame 69. Brackets 59 are provided at three places, namely, at opposite ends and middle of the lower flame member 52. Each of the brackets 59 is formed to have a generally U shape. The fixtures 61 and 62 are also formed to have a generally U shape. A hoisting ring 51B is provided on the top of each side frame member 51. For installing the noise control module 50 to the top of the main soundproof wall 43, it is lifted with the hoisting ring 51B caught by a hook at the end of a hoisting wire of the crane, and lowered until the side frame members 51 of the module 50 are fitted into the U-shaped recess 41A (see FIG. 23) of the support column 41 of H section.

Figure 27:
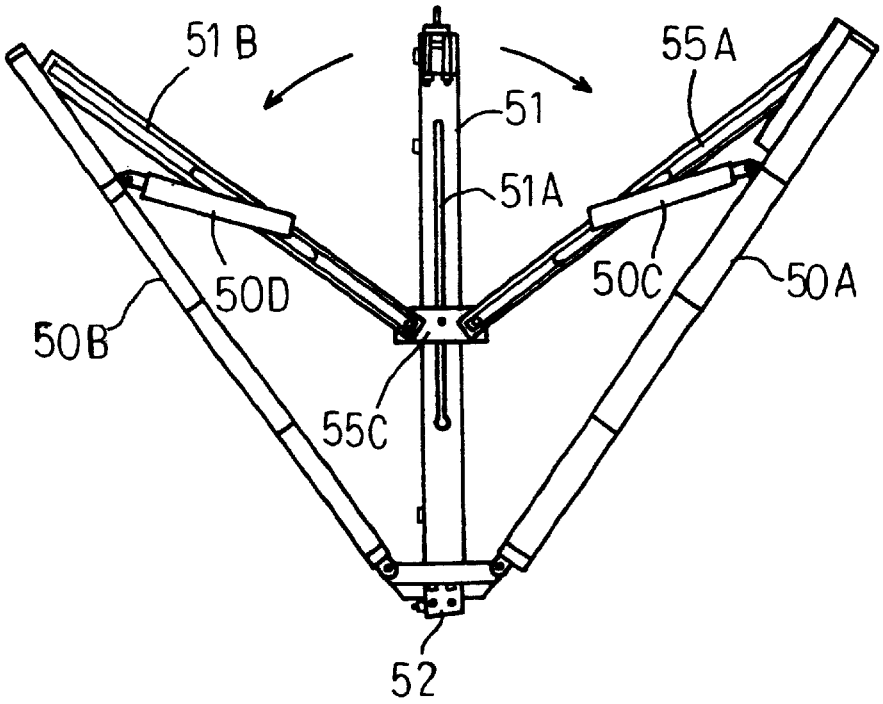
FIG. 27 is a side elevation of the noise control module being opened from the folded position.

FIG. 27 is a side elevation of the noise control module 50 being opened from the folded position in FIG. 25. The joint piece 55C is gradually lifted while the arms 55A and 55B are going to be parallel to the joint piece 55C being elevated. Also the further additional screens 50C and 50D are going to rise little by little.

Figure 28:
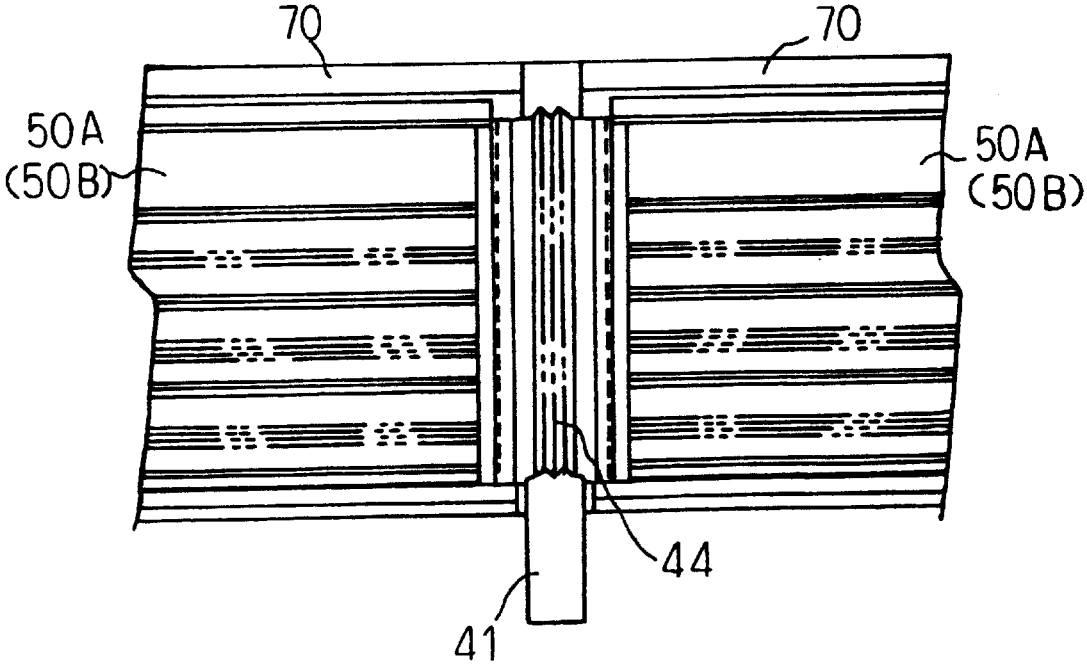
FIG. 28 is a front view of a sound insulation joint sheet used in the noise control module in FIG. 24.

FIG. 28 is a front view of the sound insulation joint sheet 44 used in the noise control module 50, showing in detail the additional screens 50A (50B) neighboring each other when they are opened, being connected to each other by the joint sheet 44 bridging over the support column 41. The sound insulation joint sheet 44 may be desirably made of a synthetic rubber such as EPDM (=ethylene propylene terpolymer), CSM (=chlorosulfonated polyethylene) or the like. It is waved for horizontal expansion and shrinkage in the plane of the drawing.

Figure 29:
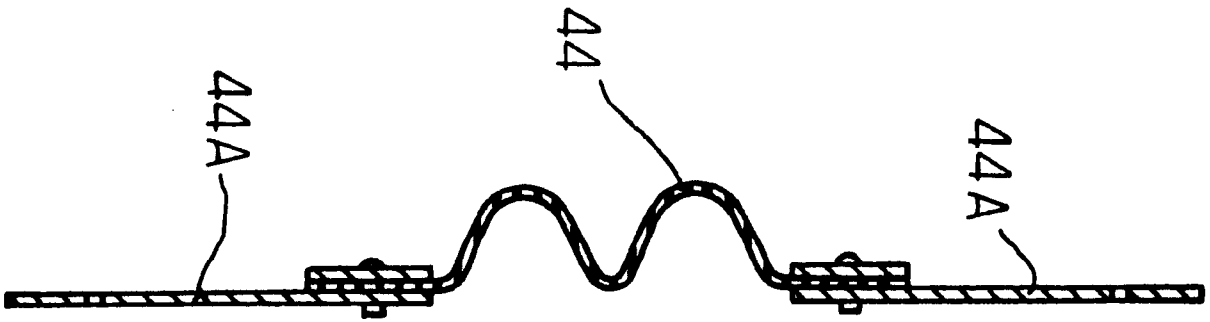
FIG. 29 is a sectional view of the sound insulation joint sheet in horizontal position.

FIG. 29 is a cross-sectional view of the sound insulation joint sheet 44. The sound insulation joint sheet 44 is fixed at both ends thereof inside the additional screens 50A and 50B. The joint sheet 44 has provided at opposite ends thereof with fixing plates 44A, respectively, which are to be fixed inside the additional screen 50A (50B). The fixing plates 44A should desirably be made of aluminum, steel or the like.

The vertical size of the clearance d shown in FIG. 26 should be 5% or less of the vertical length of the additional screen 50A, which will not adversely affect the noise control of the noise barrier. The clearance d prevents dust or rain from staying in a space defined between the additional screens 50A and 50B. In this embodiment, the clearance d is provided below the additional screen 50A nearer to the road or noise source and not at the opposite side. Alternatively, the clearance d may be defined under the additional screen 50B (at the opposite side of the noise barrier to the noise source) but not at the side nearer to the noise source. The sound insulation joint sheet 44 is waved and elastic at the middle thereof to accommodate irregular gaps between the additional screens 50A (as well as between the additional screens 50B).

Figure 30:
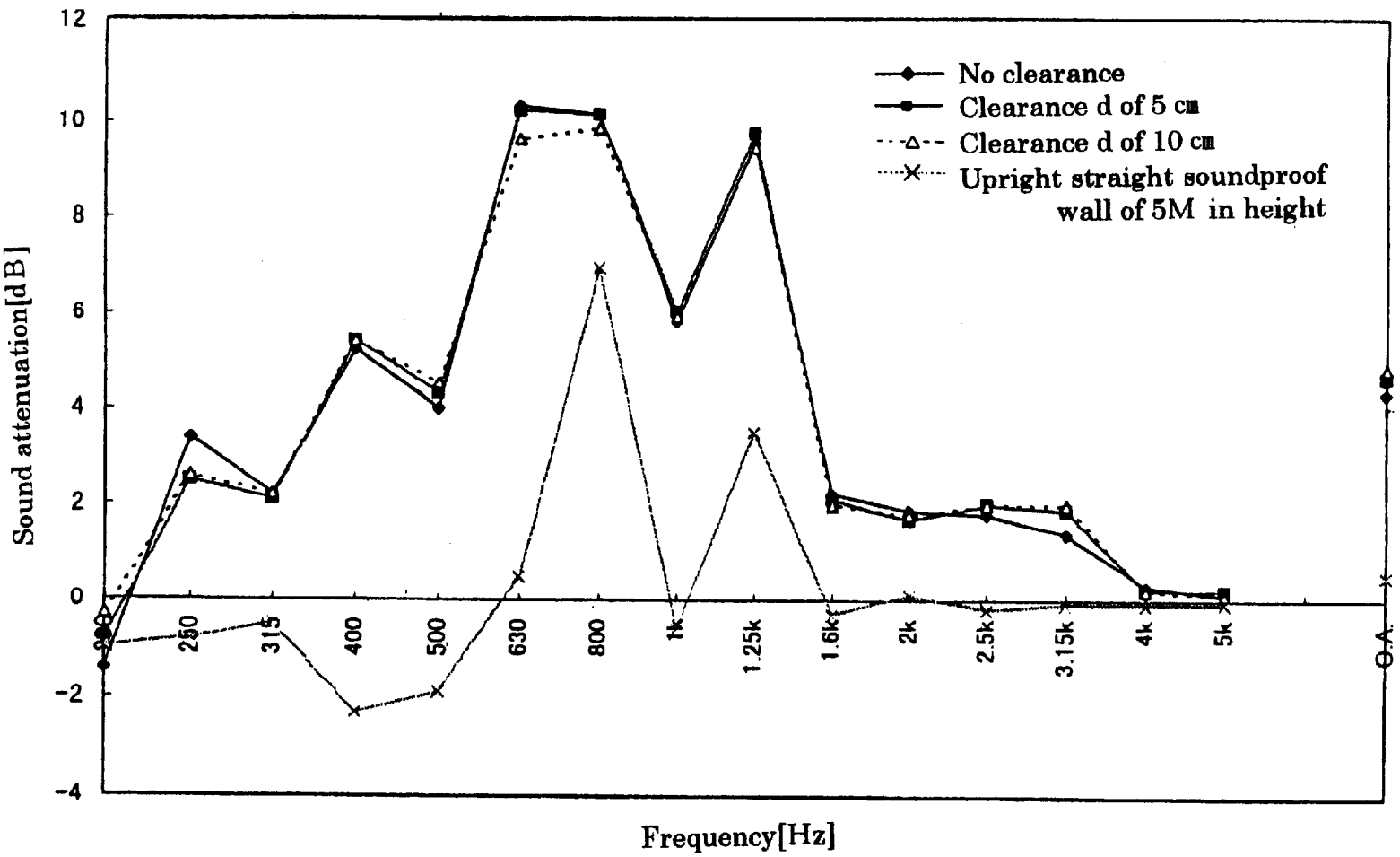
FIG. 30 is a graph showing the measured noise control by an upright straight wall type noise barrier and caribou-horn type noise barriers including three types: first one is with no clearance, a clearance of 5 cm and a clearance of 10 cm under the additional screen.

FIG. 30 is a graph showing the relationship between sound frequencies and noise control by caribou-horn type noise barriers of 5 m in height and having no clearance d, a clearance d of 5 cm and a clearance d of 10 cm, under the additional screen 50A, and by a conventional upright straight wall type noise barrier of 5 m in height. In this experiment, a sound source was placed at a position of 5 m from the noise barrier, and a microphone was placed at a position of 10 m from the noise barrier and at a height of 1.2 m from the ground. As seen from this graph, the effect of noise attenuation by the three caribou-horn types of noise barrier is almost same irrespectively of the existence and size of the clearance d. Also it will be seen that the noise barrier of the upright straight wall type is lower in effect of noise attenuation than the caribou-horn type noise barriers.

In the third embodiment having been described in the foregoing, the upright-standing support columns each made of an H section are erected at a predetermine distance from each other. The plurality of wall panels is provided between two neighboring ones of the support columns by inserting each wall panel at opposite lateral ends thereof from above into U-shaped recesses, opposite to each other, of the support columns. The plurality of wall panels is thus stacked one on another to form the main soundproof wall, and the noise control modules are installed on the topmost wall panel by inserting the side frame members at lower ends thereof from above into the upper portions of the U-shaped recesses, opposite to each other, of the support columns. The noise control module further comprises a lower frame member connecting the side frame members to each other by securing the side frame members at lower ends thereof to the lower frame member; first and second additional screens installed at lower ends thereof pivotably to the lower frame member and having a horizontal length smaller than the distance between the support columns; a coupling member holding the first and second additional screens at a predetermined angle of inclination when the additional screens are inclined toward and away from a noise source, respectively; and sound insulation joint sheets elastically extensible horizontally and bridging, over the support column, two additional screens put in neighboring relationship when the first and second additional screens are opened away from each other. Thus, the noise control module can be prepared and installed on the main wall very easily and rapidly at site. Also since the horizontal length of the first and second additional screens is smaller than the span between the support columns, the closed noise control module can be installed on the top of the main wall by inserting the side frame members into the U-shaped recesses of the support column 41. After securing the side frame members to the support columns, the additional screens can be opened for use. If the gaps between the neighboring additional screens are different in size from one another after the noise control module is installed as in the above, the gap difference can be accommodated by the horizontal elasticity of the sound insulation joint sheets bridged over the support column between the neighboring additional screens. Namely, since the additional screens of the noise control module can be opened and closed, the noise control module can be folded for storage and transport, which will contribute greatly to a space saving and therefore reduced costs of storage and transport. Also, the first or second additional screen is installed at the lower end thereof to the lower frame member of the noise control module with a clearance defined between them, it is possible to prevent dust or rain from staying inside the space between the additional screens. The first and second further additional screens provided on the additional screens further improve the effect of noise attenuation of the noise barrier.

What is claimed is:

1. In a noise barrier including upright-standing support columns spaced a predetermine distance from each other and each made of an H section, and a plurality of wall panels provided between two neighboring ones of the support columns by inserting each wall panel at opposite lateral edges thereof from above into U-shaped recesses, opposite to each other, of the support columns, the plurality of wall panels being thus stacked one on another to form a main soundproof wall, and a noise control module to be installed on the topmost wall panel, the noise control module comprising:

side frame members to be inserted at lower ends thereof from above into the upper portions of the U-shaped recesses, opposite to each other, of the support columns;

a lower frame member connecting the side frame members to each other by securing them at lower ends thereof to the lower frame member;

first and second additional screens installed at lower ends thereof pivotably to the lower frame member and having a horizontal length smaller than the distance between the support columns;

a coupling member holding the first and second additional screens at a predetermined angle of inclination when the additional screens are inclined toward and away from a noise source, respectively; and sound insulation joint sheets elastically extensible horizontally and bridging, over the support column, two additional screens put in neighboring relationship when the first and second additional screens are opened away from each other.

2. The noise barrier as set forth in claim 1, wherein the first or second additional screen is installed to the lower frame member with a clearance (d) between them to be pivotable in relation to the lower frame member.

3. The noise barrier as set forth in claim 1 or 2, wherein the coupling member includes at least two arms each installed at one end thereof pivotably to upper portions of the first and second additional screens, respectively, and at the other end thereof pivotably and vertically slidably to at least one of the side frame members.

4. The noise barrier as set forth in claim 1 or 2 wherein the first and second additional screens have provided as rising from the inner surfaces thereof, respectively, first and second further additional screens defining open spaces between them and upper portions of their corresponding additional screens.

5. The noise barrier as set forth in claim 4, wherein each of the first and second further additional screens is installed at one end thereof pivotably to inner surfaces of the first and second additional screens, and at the other end thereof to the arms of the coupling member to be pivotable and slidable longitudinally of the arms.

* * * * *